United States Patent [19]

Bartos

[11] Patent Number: 4,750,485

[45] Date of Patent: Jun. 14, 1988

[54] PORTABLE EMERGENCY BREATHING APPARATUS

[75] Inventor: Josef A. Bartos, Diamond Bar, Calif.

[73] Assignee: Respirator Research Ltd., Willoughby, Ohio

[21] Appl. No.: 938,616

[22] Filed: Dec. 5, 1986

Related U.S. Application Data

[62] Division of Ser. No. 762,253, Aug. 5, 1985, abandoned.

[51] Int. Cl.[4] ..... A62B 7/00

[52] U.S. Cl. ..... 128/205.24; 128/204.26; 137/495

[58] Field of Search ..... 128/204.26, 204.28, 128/205.12, 205.22, 205.24, 205.27, 205.28; 222/3; 137/495, 565, 614.19, 906

[56] References Cited

U.S. PATENT DOCUMENTS

| | | | |
|---|---|---|---|
| 2,041,406 | 7/1935 | Foregger . | |
| 2,117,952 | 5/1938 | Gourdou . | |
| 2,119,473 | 5/1938 | Smith et al. . | |
| 2,324,716 | 7/1943 | Nohl . | |
| 2,348,074 | 5/1944 | Lambertsen . | |
| 2,403,991 | 7/1946 | Murphy et al. . | |
| 2,687,018 | 8/1954 | Baldwin et al. . | |
| 2,836,189 | 5/1958 | Holmes . | |
| 2,852,023 | 9/1958 | Hamilton et al. . | |
| 2,951,494 | 9/1960 | Holmes | 137/908 |
| 3,097,638 | 7/1963 | Streimer . | |
| 3,208,449 | 9/1965 | Bartlett, Jr. . | |
| 3,410,778 | 11/1968 | Krasberg . | |
| 3,604,416 | 9/1971 | Petrahal . | |
| 3,648,893 | 3/1972 | Whiting . | |
| 3,768,466 | 10/1973 | Johnson | 137/78 |
| 4,168,706 | 9/1979 | Fletcher . | |
| 4,186,735 | 2/1980 | Henneman et al. | 128/201.25 |
| 4,243,155 | 1/1981 | Stewart | 222/3 |
| 4,409,978 | 10/1983 | Bartos . | |

FOREIGN PATENT DOCUMENTS

| | | | |
|---|---|---|---|
| 1222801 | 8/1966 | Fed. Rep. of Germany | 128/205.12 |
| 1247868 | 8/1967 | Fed. Rep. of Germany | 128/204.26 |
| 1456306 | 8/1969 | Fed. Rep. of Germany | 128/204.26 |
| 799122 | 6/1936 | France | 222/3 |
| 22648 | 2/1962 | German Democratic Rep. | 128/205.12 |
| 485981 | 10/1953 | Italy | 222/3 |
| 447334 | 5/1936 | United Kingdom | 128/205.12 |
| 1939335 | 5/1967 | U.S.S.R. | 128/205.12 |

*Primary Examiner*—William E. Kamm
*Assistant Examiner*—Angela D. Sykes
*Attorney, Agent, or Firm*—Body, Vickers & Daniel

[57] ABSTRACT

Closed circuit emergency breathing apparatus is disclosed which is comprised of concentrically associated oxygen container and scrubber components, and a flow control valve assembly mounted on the open end of the compressed oxygen container and against the corresponding end of the scrubber. Unique valve structures enable the provision of all valve functions by valve components provided in a common support arrangement by which the valve assembly is mounted on the compressed oxygen container and structurally interrelated with the corresponding end of the scrubber. Breathing hose, pressure gauge and burst valve components are also mounted on the common support, and a breathing bag is mounted on the scrubber between the opposite ends thereof.

13 Claims, 12 Drawing Sheets

FIG. 9
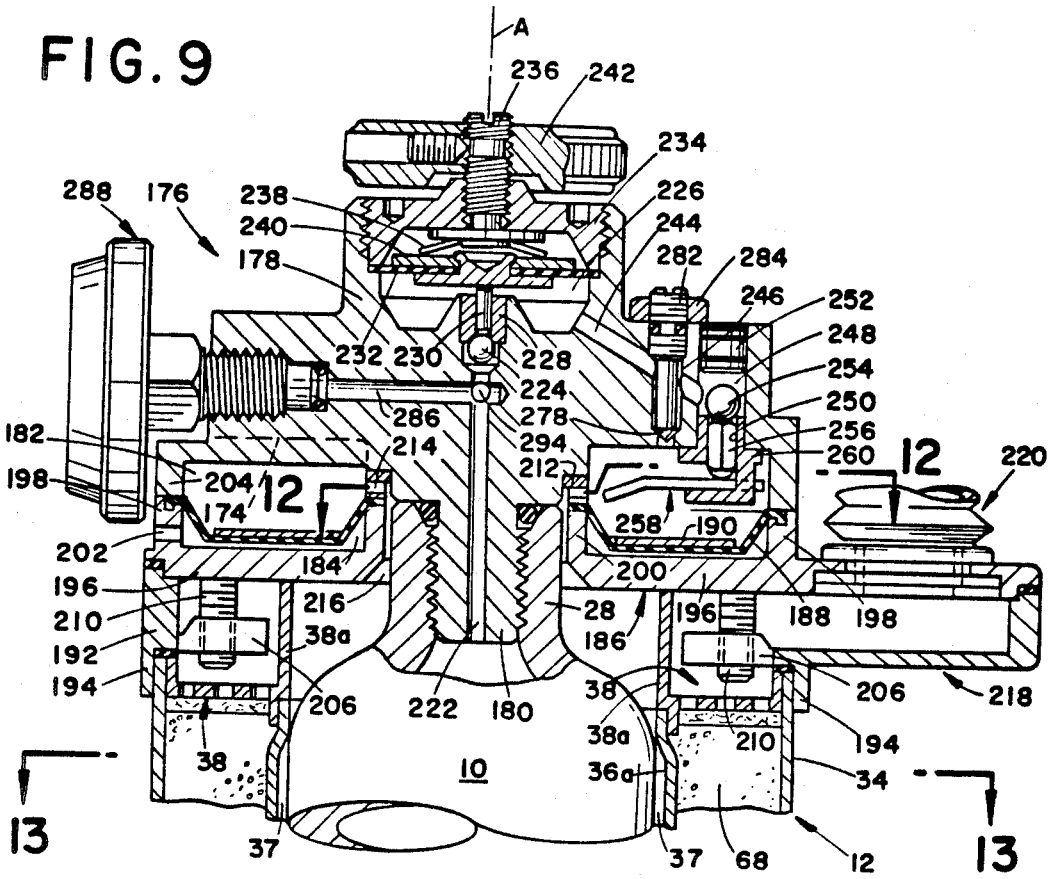
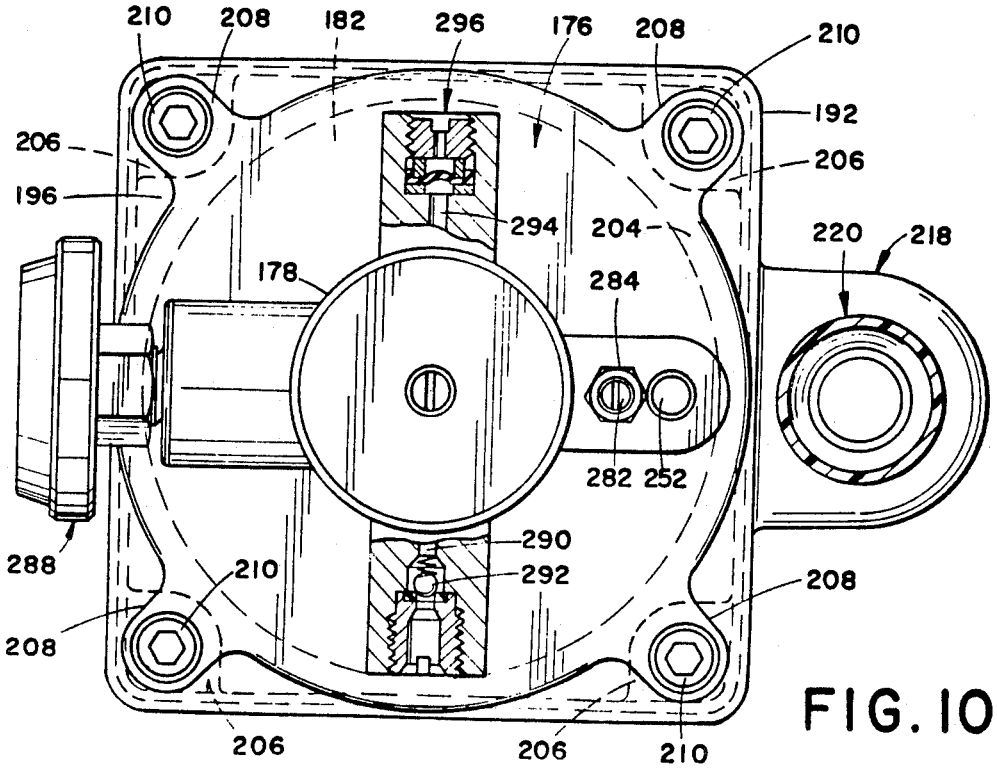
FIG. 10

FIG. 14
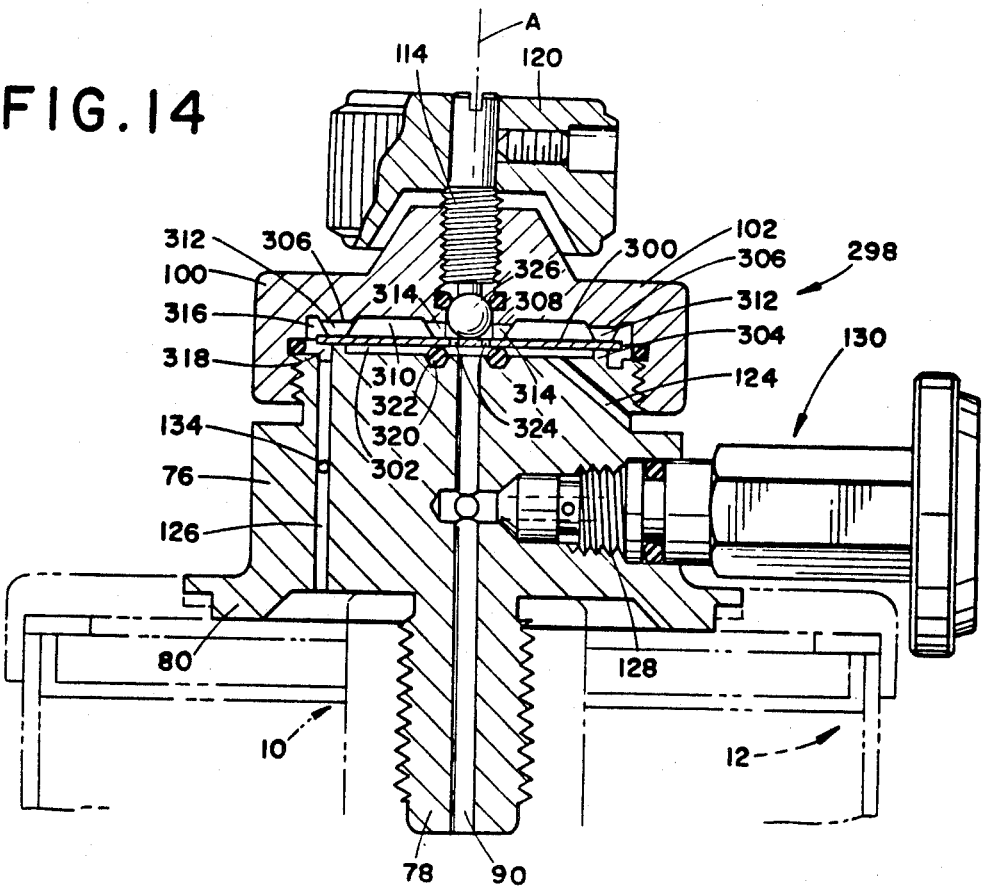
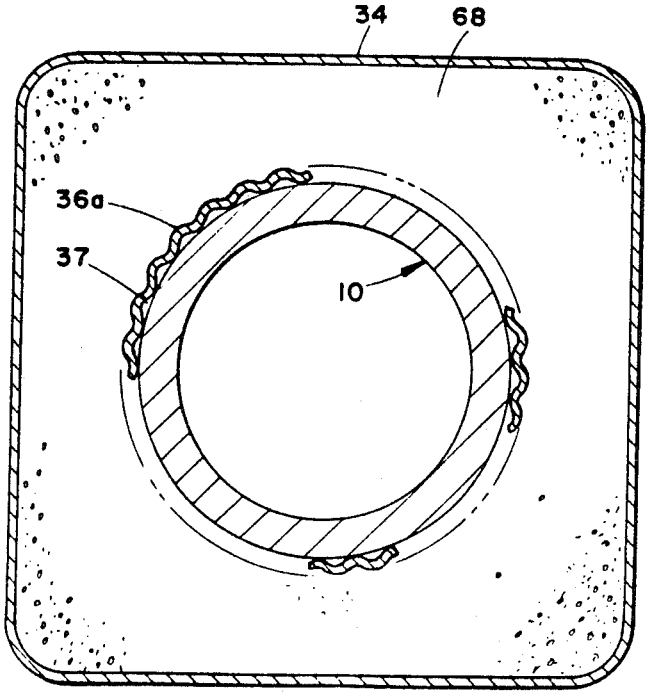
FIG. 13

PORTABLE EMERGENCY BREATHING APPARATUS

This is a division of application Ser. No. 762,253 filed Aug. 5, 1985, now abandoned.

BACKGROUND OF THE INVENTION

The present invention relates to the art of portable emergency breathing apparatus and, more particularly, to improvements in connection with breathing apparatus of the character in which breathing gas is re-breathed.

Breathing apparatus of the character wherein exhaled breath of a user is mixed with oxygen from a supply container, scrubbed to reduce the concentration of exhaled carbon dioxide, and re-breathed by the user is generally referred to as closed circuit breathing apparatus. The primary advantage of such apparatus over open circuit apparatus wherein oxygen under pressure from a container is continuously supplied to a hood or face mask worn by the user and wherein the air breathed by the user is exhaled to atmosphere, is the fact that closed circuit apparatus enables optimizing the duration of use thereof with a given sized compressed oxygen container. At the same time, such apparatus presently available is comprised of a considerable number of component parts which, as a result of the size, cost and structural interrelationship therebetween results in the apparatus being undesirably expensive, large in overall dimensions and heavy. Furthermore, such apparatus heretofore available have exposed component parts which are subject to easy damage and this, together with the weight and size, makes the apparatus undesirable in certain environments of potential use. More particularly with regard to such disadvantages, the compressed oxygen cylinder and scrubber components of the apparatus have been structurally separate components disposed side-by-side or, in some instances, completely separate from one another and interconnected by elaborate flow line systems. With regard to flow control valve arrangements for such apparatus which generally includes a shutoff valve, a pressure reducing valve and a demand valve for supplying air from the compressed air cylinder in response to the user's breathing, these valves heretofore have been structurally separate components mounted at different locations within the confines of the apparatus. Accordingly, it will be appreciated that the cost of the apparatus is affected by having to provide two or three structurally independent valves, by having to provide fittings for mounting the valves, and by the time required in connection with assembly of the apparatus.

One previous effort to provide a compact, light weight closed circuit re-breathing device is disclosed in U.S. Pat. No. 3,208,449 to Bartlett. The Bartlett apparatus is characterized by the wrapping of tubing around a scrubber canister to provide a compressed oxygen source. The canister is directly attached to a face mask, and a breathing bag is attached to the bottom of the canister. While achieving compactness, the Bartlett arrangement does not overcome the other disadvantages referred to hereinabove and, additionally, introduces other disadvantages. In this respect, without regard to the quantity of oxygen which the tubing is capable of holding, external exposure of the tubing is disadvantageous from the standpoint of potential damage or rupture either prior to or during use and, during use in an emergency situation such as a fire, undesirably exposes the stored oxygen directly to ambient heat and thus the potential that the user will be breathing hot air. With regard to the other disadvantages referred to hereinabove, the Bartlett unit requires structurally separate pressure reducing and demand valves, and the pressure reducing valve and a pressure gauge for the unit are exposed laterally of the unit and in locations subjecting these components to potential damage, again either prior to or during use. A further disadvantage resides in the fact that the entire unit is supported on the head of the user through the face mask which, regardless of the lightness of weight, is both uncomfortable for the user and restricts movement of the head of the user from side-to side without potentially dislodging the mask from its position over the user's face by engagement of the depending apparatus with the user's chest and shoulders.

SUMMARY OF THE INVENTION

In accordance with the present invention, closed circuit breathing apparatus is comprised of component parts which are structured and structurally interrelated to provide optimum compactness for the apparatus without the disadvantages of the Bartlett apparatus described above and without the other disadvantages referred to hereinabove with regard to apparatus heretofore available. More particularly in accordance with the present invention, oxygen is stored under pressure in a container which optimizes the available supply relative to the overall size of the unit, and the scrubber canister provides a scrubber chamber which is radially outwardly adjacent and coaxial with the oxygen container. This advantageously provides for the breathing gas being scrubbed to flow axially along the outer side of the supply container to optimize heat transfer therebetween and comfort for the user with respect to the temperature of the gas being breathed. Compactness is further promoted by providing a unitary valve assembly mounted on the open end of the compressed oxygen container for controlling the on-off and gas flow functions during use of the apparatus. As will become apparent hereinafter, the valve assembly may include on-off and pressure reducing valves and, additionally, a demand valve. In any event, a unique unitary valve construction is provided which is coaxial with the oxygen supply container and with the scrubber canister and which is structurally interrelated with the open end of the supply container and the corresponding end of the canister for the flow of oxygen and re-breathed gas through the breathing circuit of the apparatus. The breathing hose connection to the apparatus is preferably associated with the valve assembly, and the breathing bag has its open end surrounding the scrubber canister at a location between the opposite ends thereof in a manner whereby the lower end of the oxygen supply container and that portion of the scrubber canister below the open end of the bag are enclosed thereby. The capacity of the unit in connection with the available time for use is of course determined by the volume of the oxygen supply container, and containers of different lengths can be used, selectively, to provide a desired use duration for the unit.

It is accordingly an outstanding object of the present invention to provide improved portable emergency breathing apparatus of the closed circuit type.

Another object is the provision of apparatus of the foregoing character comprised of component parts structured and structurally interrelated to promote compactness of the apparatus, while minimizing exposure of critical parts to physical damage during storage or use of the apparatus.

Yet another object is the provision of improved apparatus of the foregoing character which comprises a compressed oxygen supply container and a scrubber canister structurally interrelated with one another to promote optimum comfort of the user of the apparatus with respect to the gas breathed during use.

A further object is the provision of improved apparatus of the foregoing character wherein the compressed oxygen container and scrubber canister have corresponding ends structurally interrelated with a unitary flow control valve assembly, thus to promote compactness and minimum exposure of external component parts to damage, and to reduce the number of separate component parts of the apparatus and thus the costs of component parts and the time required to assemble the apparatus.

Still another object is the provision of improved apparatus of the foregoing character which optimizes the overall size of the apparatus relative to a given duration of use and through component parts structured and structurally interrelated to promote ease and efficiency with respect to use of the apparatus and improved efficiency with respect to the operation thereof.

Yet a further object is the provision of an improved flow control valve assembly for controlling the flow of fluid under pressure from a source connected to the inlet side of the valve by means of coaxially arranged pressure reducing and demand valves responsive to pressure variations at the outlet side of the valve downstream from the demand valve.

BRIEF DESCRIPTION OF THE DRAWINGS

The foregoing objects, and others, will in part be obvious and in part pointed out more clearly hereinafter in conjunction with the written description of preferred embodiments of the invention illustrated in the accompanying drawings in which:

FIG. 9 is a sectional elevation view of another embodiment of the valve assembly for the apparatus;

FIG. 10 is a plan view, partially in section, of the valve assembly shown in FIG. 9:

FIG. 13 is a cross-sectional view of the scrubber canister taken along line 13—13 in FIG. 9;

FIG. 14 is a sectional elevation view of another embodiment of a pressure reducing valve for the apparatus:

DESCRIPTION OF PREFERRED EMBODIMENTS

Figure 1:
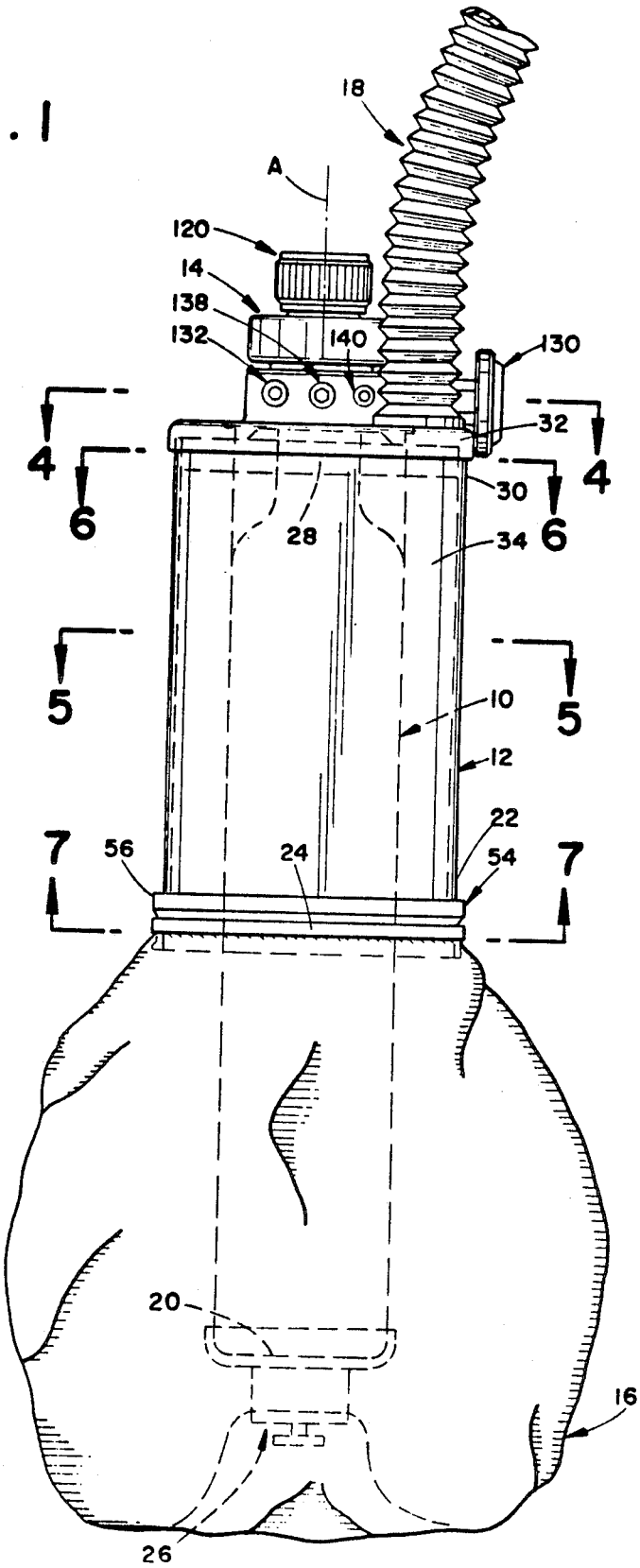
FIG. 1 is a somewhat schematic elevational view of portable emergency breathing apparatus in accordance with the present invention.

Referring now in greater detail to the drawings wherein the showings are for the purpose of illustrating preferred embodiments of the invention only, and not for the purpose of limiting the invention, FIG. 1 somewhat schematically illustrates in elevation portable emergency breathing apparatus in accordance with the present invention and which has an axis A and is comprised of concentrically arranged component parts including an oxygen supply cylinder 10, a scrubber 12, a flow control valve assembly 14, a breathing bag 16, and a breathing hose 18 leading to a hood or face mask, not shown, which is worn by a user of the apparatus. Cylinder 10 has a closed bottom end 20 and, in the embodiment shown in FIG. 1, breathing bag 16 is attached to lower end 22 of the scrubber by a suitable removable bag retaining band component 24. Further as shown in the embodiment illustrated in FIG. 1, cylinder 10 extends below lower end 22 of scrubber 12 and is disposed within breathing bag 16. The bottom of the bag is provided with a low pressure relief valve 26 which, as described hereinafter, is supported on the bottom of cylinder 10 and provides a point of attachment for a strap by which the apparatus is held against the body of a person during use. Cylinder 10 has an open upper end 28 and scrubber 12 has a corresponding upper end 30. Valve assembly 14 is mounted on upper end 28 of cylinder 10 and is interconnected with a cap member 32 on upper end 30 of scrubber 12. As will become apparent hereinafter, valve assembly 14 is operable to control the flow of oxygen from cylinder 10 with respect to a breathing circuit comprising scrubber 12, breathing bag 16 and breathing hose 18.

With reference now in particular to FIGS. 2 and 5-7 of the drawing, scrubber 12 is in the form of a canister having an outer wall 34 which is generally square in cross-section and an inner wall 36 which is circular in cross-section and which surrounds and engages the outer surface of cylinder 10. The upper ends of walls 34 and 36 are interconnected and maintained in coaxial relationship by means of an apertured plate member 38 having an axially upwardly extending flange 40 about the periphery thereof and engaging the inner side of the upper end of wall 34, a circular inner edge 42, and a downwardly extending circular flange 44 engaging the outer surface of the upper end of wall 36. Plate 38 is provided with holes 46 therethrough for the passage of breathing gas through the breathing circuit as described more fully hereinafter. Further, and for the same purpose, the upper end of inner wall 36 is provided about the periphery thereof with holes 48, and suitable filters 50 and 52 of felt material, for example, are provided beneath holes 46 and radially outwardly of holes 48 to catch any solid particulate material which may be entrained in the gas being circulated through the breathing circuit. The lower ends of walls 34 and 36 are interconnected and maintained in coaxial relationship by a lower end cap member 54 having an upwardly extending peripheral flange 56 conforming to the contour of wall 34 and engaging about the outer surface thereof, an axially downwardly extending circular flange 58 about which the upper end of bag 16 is engaged by bag retaining band 24, and a circular opening 60 therethrough having a circumferentially continuous recess 62 therein receiving the lower end of canister wall 36. The portion of end cap 54 between flange 58 and opening 60 is provided with a plurality of holes 64 about the periphery of opening 60 which provide communication between breathing bag 16 and the lower end of scrubber 12, and a filter of felt or the like 66 overlies the upper ends of holes 64. The annular space between canister walls 34 and 36 between the axially opposite ends of the walls is filled with a granular carbon dioxide absorbing material 68 such as, for example, Soda-Sorb which is comprised of sodium hydroxide and calcium oxide and is available through the Dewey and Alney Division of W. R. Grace Company. Upper end cap 32 referred to hereinabove overlies the axially upper ends of canister wall 34 and flange 40 of plate member 38 and thus is axially spaced above plate member 38. The end cap includes an axially downwardly extending peripheral flange 70 which conforms to the contour of canister wall 34 and is suitably secured thereto, and a suitable sealing ring 72 is axially interposed between the underside of cap member 32 and the upper ends of canister wall 34 and flange 40. Cap member 32 further includes a circular recess 74 for the purpose set forth below.

With reference now in particular to FIGS. 1–4 of the drawing, valve assembly 14 includes a body member 76 having an externally threaded downwardly extending nipple 78 received in and threadedly interengaged with the internally threaded open upper end 28 of cylinder 10. Valve body 76 includes a radially outwardly extending peripheral flange 80 having a circular outer periphery and a circular recess 82 in the underside thereof which overlies the circular recess 74 in the axially outer side of end cap 32. A sealing ring 84 is axially interposed between recesses 74 and 82, and scrubber 12 is releaseably interengaged with the valve assembly and thus cylinder 10 by means of a pair of retaining screws 86 threadedly interengaged with openings therefor in cap member 32 and having radially outwardly extending flanges overlying flange 80 of body member 76 as will be appreciated from FIG. 4.

Valve assembly 14 in the embodiment illustrated in FIGS. 1–4 provides on-off functions with respect to the flow of oxygen from cylinder 10 and a pressure reducing function in connection with the delivery of oxygen from cylinder 10 to the breathing circuit. More particularly in this respect, the upper end of body member 76 is provided with a diaphragm chamber 88 and an axially extending passageway 90 having an upper end opening thereinto and a lower end opening into cylinder 10. A sheet metal hat-shaped diaphragm 92 is disposed in diaphragm chamber 88 and includes a generally flat circular end wall 94 adjacent and transverse to the upper end of passageway 90, a cylindrical side wall 96, and a radially outwardly extending circumferential flange 98. The radially outer end portion of flange 98 is disposed against the outer end of body member 76, and the diaphragm is mounted on the body member by means of a cap member 100 having an end wall 102 provided on the inner side thereof with an annular axially extending rib 104 which axially engages the radially outer end of diaphragm flange 98 against body member 76. An annular recess 106 is also provided on the inner side of end wall 102 of cap member 100 radially outwardly of rib 104, and rib 104 is provided with openings 108 radially thereacross between recess 106 and a recess 110 in end wall 102 radially inwardly of rib 104. The upper end of passageway 90 is flared to provide a conical seat for a ball valve element 112 which is interposed between the upper end of passageway 90 and end wall 94 of diaphragm 92. During periods of non-use of the apparatus, the flow of oxygen under pressure from cylinder 10 is shutoff by displacement of diaphragm end wall 94 downwardly against ball valve 112 to close the upper end of passageway 90. For this purpose, end cap 100 is provided with an internally threaded opening into recess 110 which receives an externally threaded rotatable valve stem 114 having a lower end 116 adjacent diaphragm end wall 94 and an outer end 118 provided with an operating knob 120 by which the stem is rotatable in opposite directions relative to axis A. Accordingly, it will be appreciated that rotation of knob 120 in one direction displaces inner end 116 of the stem axially outwardly and away from diaphragm end wall 94 to open the valve, and that rotation in the opposite direction displaces inner end 116 of the stem into engagement with diaphragm end wall 94 to displace the latter toward the upper end of passageway 90 to close the valve.

Figure 4:
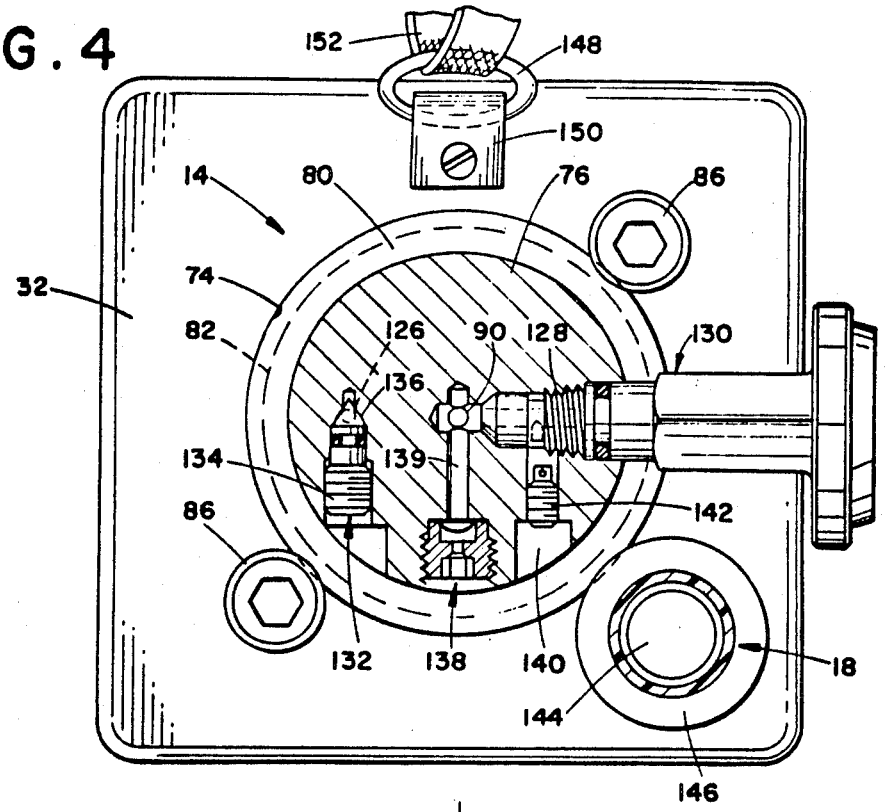
FIG. 4 is a plan view of the apparatus, partially in section, taken along line 4—4 in FIG. 1.
Figure 3:
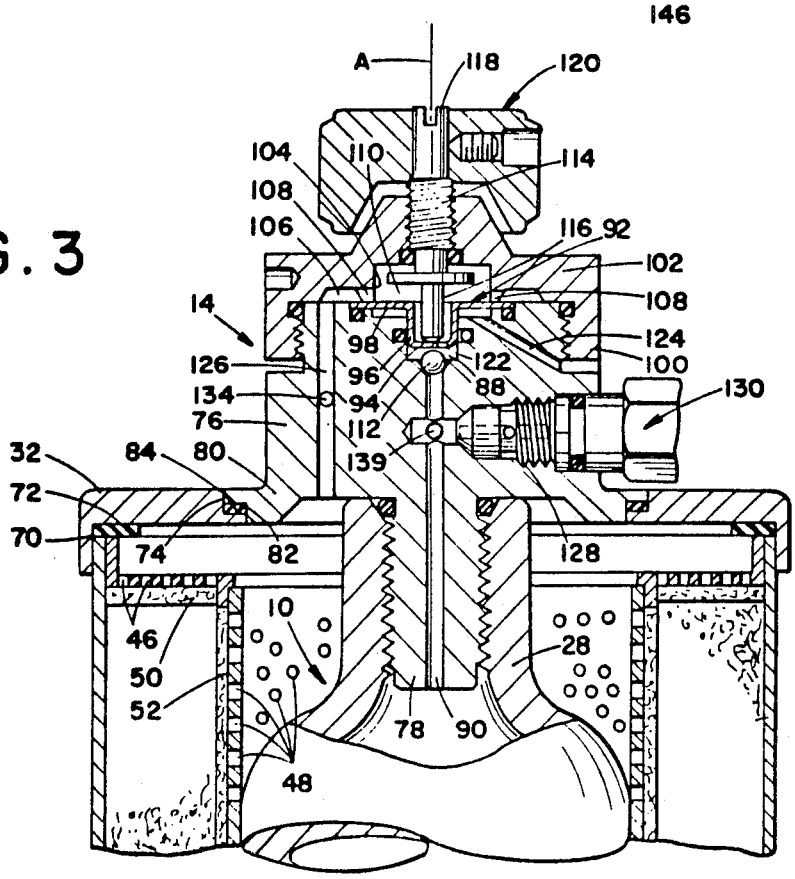
FIG. 3 is an enlarged sectional elevational view of the valve assembly.
Figure 5:
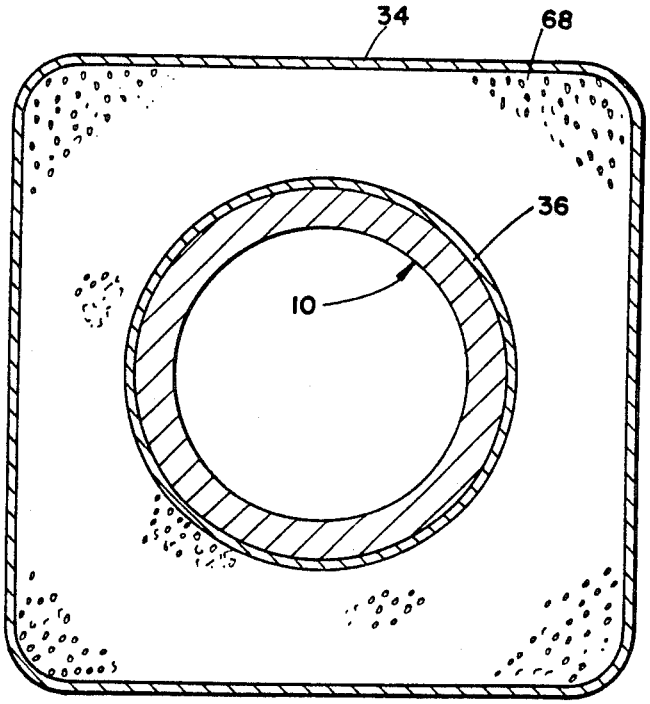
FIG. 5 is a cross-sectional view of the scrubber canister taken along line 5—5 in FIG. 1.
Figure 6:
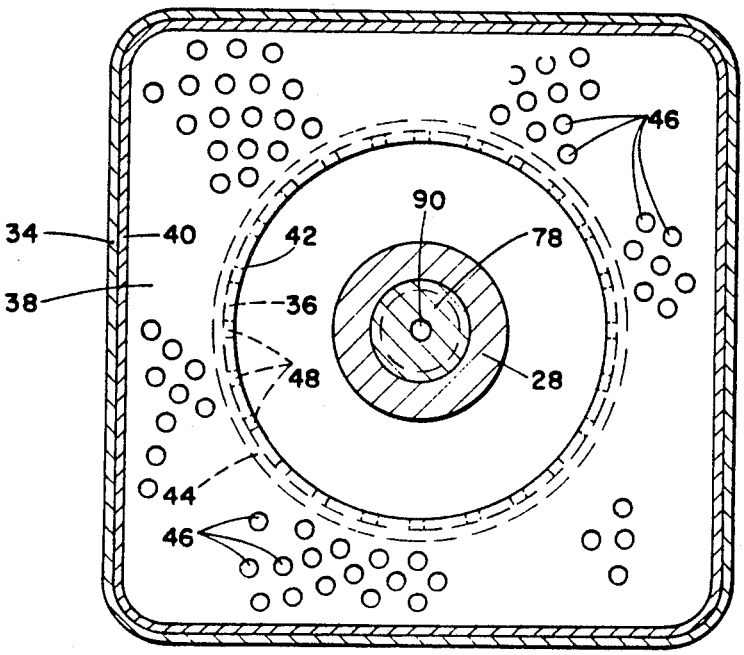
FIG. 6 is a cross-sectional view of the upper end of the scrubber canister taken along line 6—6 in FIG. 1.
Figure 7:
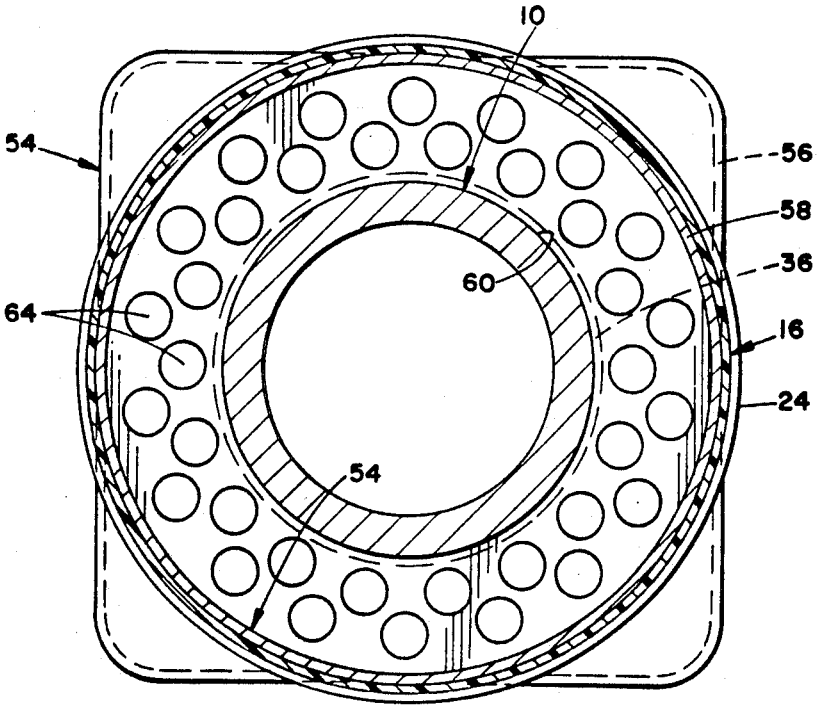
FIG. 7 is a bottom view of the scrubber canister taken along line 7—7 in FIG. 1.

End wall 94 of diaphragm 92 is provided with a port 122 therethrough between the upstream and downstream sides of the diaphragm relative to the flow of oxygen from cylinder 10. Appropriate seals, not designated numerically, are interposed between body member 76 and cylindrical side wall 96 of the diaphragm and between diaphragm flange 98 and body member 76, and the space between these seals is vented to atmosphere by means of a passageway 124. The flow path through the valve body further includes an axially extending passageway 126 having an upper end in communication with recess 106 in cap member 100 and a lower end opening into the space between upper end 28 of cylinder 10 and the upper end of scrubber 12. The valve assembly further includes, as best seen in FIGS. 3 and 4, a laterally extending passageway 128 having an inner end communicating with passageway 90 and which is adapted to receive a pressure gauge 130 which provides a visual indication of the pressure of the oxygen in cylinder 10. Further, as best seen in FIGS. 1 and 4 of the drawing, valve assembly 14 includes an adjustable flow restricting valve 132 threadedly interengaged with an opening 134 provided therefor in body member 76 and having an inner end 136 for restricting the flow of oxygen through passageway 126 in accordance with the position of inner end 136 relative to the passageway and for the purpose set forth hereinafter. Valve 132 is preset to provide a predetermined flow of oxygen from cylinder 10 when the apparatus is in use. A high pressure relief or burst valve 138 is provided in body member 76 for the purpose well known in connection with emergency breathing apparatus. Burst valve 138 is in communication with port 90 by means of a passageway 139.

A fill port 140 is provided in body 76 to facilitate filling cylinder 10 with oxygen, and port 140 has an inner end communicating with passageway 128 for pressure gauge 130. A spring biased check valve 142 provides for the inflow of oxygen to cylinder 10 while preventing air escape through the fill port. As best seen in FIGS. 1 and 4, end cap 32 on scrubber 12 is provided with an opening 144, and breathing tube 18 is connected to end cap 32 for communication with opening 144 by means of a suitable coupling collar 146.

Figure 8:
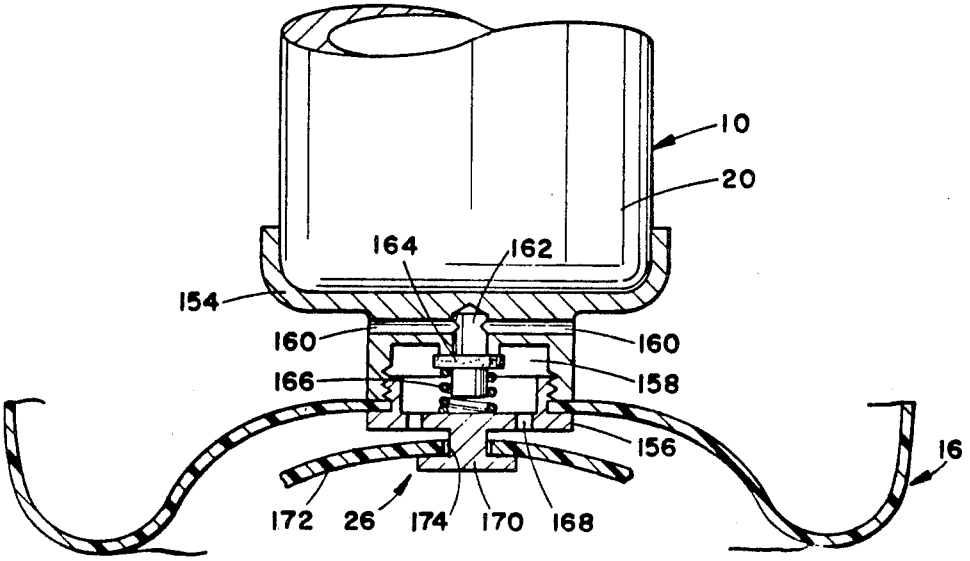
FIG. 8 is a sectional elevation view of the relief valve associated with the breathing bag.

As best seen in FIG. 4 of the drawing, cap member 32 of the scrubber is provided with a strap loop 148 attached thereto by a bracket 150, and a strap 152, only partially shown, extends through loop 148. The strap preferably is of adjustable length and is introduced over the head of the user during use of the apparatus so that the apparatus is suspended in front of the user. Preferably, the lower end of the apparatus is strapped about the body of the user so as to prevent the apparatus from moving outwardly from the user's body or from side-to-side relative thereto. Such strapping can be achieved in any desired manner and, in the embodiment illustrated and as best seen in FIG. 8, the body strap is adapted to be attached to low pressure relief valve 26. More particularly in this respect, relief valve 26 includes a body portion 154 having an upper end conforming to the contour of and suitably secured to bottom end 20 of cylinder 10. Body portion 154 has a lower end to which a retaining cap member 156 is secured so as to peripherally capture the marginal portion of an opening in the bottom of breathing bag 16 between the body and cap. Body member 154 has an internal chamber 158 in flow communication with the interior of breathing bag 16 by means of laterally extending ports 160 and an axially extending central port 162, and the lower end of port 162 is normally closed by a valve element 164 which is biased against the lower end of the port by means of a spring 166. When the pressure in breathing bag 16 exceeds a predetermined amount, valve element 164 is displaced downwardly against the bias of spring 166, whereby gas in the breathing bag escapes into chamber 158 and thence to atmosphere through ports 168 in cap member 156. Cap member 156 is provided at its lower end with a projection or button 170 to which a body strap 172 is suitably attached such as by providing the strap with a button-type hole 174 receiving projection 170. Alternatively, projection 170 could receive a spring clip having a loop to which the ends of a pair of body straps would be attached. In either event, it will be appreciated that strap 172 extends about the body of the user and has free ends which are adapted to be fastened together. It will be appreciated that the mounting of relief valve 26 on container 10 enables the valve to serve both its pressure relief function and the function through strap 172 of holding the lower end of the apparatus against the body of the user.

It is believed that the following description of the operation of the embodiment illustrated in FIGS. 1–8 will be understood from the foregoing description. When it is desired to use the apparatus, the latter is put on the user by means of the neck and body straps as described above, and the face mask or hood is applied to the head of the user. Operating knob 120 is rotated to displace the lower end of valve stem 116 axially upwardly to open the valve to flow of oxygen from cylinder 10. When the shutoff valve is so opened oxygen under pressure from cylinder 10 flows upwardly through passageway 90 past ball valve h12 and operates against the area of end wall 94 of the diaphragm to displace the latter axially upwardly. The oxygen flowing past ball valve 112 flows through port 122 in end wall 94 of the diaphragm and thence through radial passageways 108 into recess 106 and the upper end of passageway 126. The setting of flow restricting valve 132 creates a back pressure on the downstream side of diaphragm 92 and the area thereof defined by the corresponding side of end wall 94 and the radial flange 98. Since this area is larger than the area of end wall 94 acted upon by oxygen under pressure from cylinder 10, the diaphragm is displaced downwardly toward the upper end of passageway 90 so as to control the area of the opening for flow of oxygen past ball valve 112 thus to reduce the pressure of the oxygen flowing into the upper end of scrubber 12 and the inlet end of breathing hose 18. Breathing bag 16 is of course collapsed when the apparatus is first turned on by opening the shutoff valve, and any exhaled air from the user together with initial oxygen flow from cylinder 10 flows into the upper end of scrubber 16 through openings 46 and 48 and thence downwardly through granular material 68 to the breathing bag to expand the latter. Thereafter, the inhaling of breathing gas by the user results in gas in the breathing bag flowing upwardly through scrubber 12 to the inlet end of the breathing hose and thence to the user together with oxygen from cylinder 10, and the exhaling of the user results in the flow of exhaled air downwardly through scrubber 12 to breathing bag 16 together with oxygen from cylinder 10. Since the breathed gas is recirculated as opposed to being exhaled to atmosphere, low pressure relief valve 26 in breathing bag 16 opens at a predetermined low pressure in the breathing bag to prevent excessive expansion and rupture or bursting thereof. After use of the apparatus, operating knob 120 is rotated to close the shutoff valve and thus stop the flow of oxygen from cylinder 10.

FIGS. 9–13 of the drawing illustrate another embodiment of a flow control valve assembly for use with scrubber and cylinder components similar to those described hereinabove in connection with FIGS. 1–8. More particularly in this respect, a flow control valve assembly 176 is illustrated in FIGS. 9–12 which includes a demand valve in addition to a shutoff and pressure reducing valve as in valve assembly 14 described hereinabove. Valve assembly 176 comprises a body portion 178 having a threaded nipple 180 on the lower end thereof received in and threadedly interengaged with the internally threaded upper end 28 of cylinder 10. The underside of valve body 178 is provided with a circumferentially continuous recess 182 which, together with a circunferentially continuous recess 184 in a scrubber end cap assembly 186, provides a diaphragm chamber for a flexible annular demand valve diaphragm 188 having an annular reinforcing plate 190 suitably secured thereto.

As will be appreciated from FIGS. 9 and 10 of the drawing, end cap assembly 186 includes a lower portion comprising an axially extending peripheral wall 192 having a contour corresponding to that of scrubber 12 and having a peripheral flange 194 at the lower end thereof engaging about the upper end of the scrubber. The end cap assembly further includes an upper portion having a bottom wall 196 and circular outer and inner walls 198 and 200, respectively. extending axially upwardly therefrom and defining recess 184 with bottom wall 196. Outer wall 198 is provided with a port 202 which vents recess 184 to atmosphere. Further, outer wall 198 axially underlies the peripheral outer wall 204 of recess 182 in the underside of body member 178, and the radially outer periphery of diaphragm 188 is axially clamped between walls 198 and 204. Further in this respect, wall 192 of the lower portion of end cap assembly 186 is provided in the four corners thereof with mounting lugs 206 beneath bottom wall 196 and radially outwardly of wall 198, and wall 204 of valve body 178 is provided with radially outwardly extending mounting lugs 208 which overlie mounting lugs 206. Aligned openings are provided through the mounting lugs, and the openings in mounting lugs 206 are threaded to receive the threaded lower ends of mounting bolts 210 having headed upper ends engaging against mounting lugs 208. It will be appreciated too that mounting bolts 210 serve to fasten scrubber 12 to the valve assembly. The radially inner edge of diaphragm 188 is axially clamped between wall 200 of cap assembly 186 and a spacer ring 212 provided on the underside of valve body 178 and which spacer ring has a plurality of radial ports 214 therethrough. The radially inner side of ring 212 in the area of ports 214 and the radially inner side of wall 200 of the end cap assembly are radially spaced from neck 28 of cylinder 10 to provide an annular passageway 216 thereabout for the purpose set forth hereinafter. As will be further appreciated from FIGS. 9–12, the upper and lower portions of end cap assembly 186 are contoured to provide a laterally outwardly extending breathing hose mounting projection 218, the interior of which communicates with the upper end of scrubber 12 and the top wall of which is provided with an opening to which a flexible breathing hose 220 is suitably coupled.

Valve body 178 is provided with a central, axially extending passageway 222 having a lower end opening into the interior of container 10 and an upper end opening into a first ball valve chamber in which a ball valve 224 is disposed. The ball valve chamber communicates with a diaphragm chamber 226 by way of a sleeve 228 having a lower end providing a seat for ball valve 224, and a stem or rod 230 is attached to ball valve 224 and extends through sleeve 228 for the upper end of the rod to be disposed in chamber 226. A diaphragm assembly including a flexible diaphragm 232 is mounted in the diaphragm chamber by means of an externally threaded disc 234 which axially clamps the radially outer periphery of diaphragm 232 against a shoulder at the upper end of chamber 226. Disc 234 includes a central opening therethrough which is internally threaded to receive an adjusting screw 236 which is provided on its axially inner end with a Bellville spring washer 238 which engages against a back-up plate 240 of the diaphragm assembly. The axially outer end of screw 236 is provided with an operating knob 242 by which the screw is rotatable in opposite directions to displace washer 238 toward and away from back-up plate 240 for the purpose set forth hereinafter. A passageway 244 extends from diaphragm chamber 226 across a flow port 246 to a second ball valve chamber 248 which communicates with diaphragm chamber 182 through a passageway 250. The outer end of chamber 248 is closed by a plug 252, and a ball valve 254 is disposed in chamber 248 and is adpated to seat against the upper end of and close passageway 250 as described hereinafter. A square pin or rod 256 is disposed in passageway 250 between ball valve 254 and an underlying portion of a ball valve actuator component 258.

Figure 11:
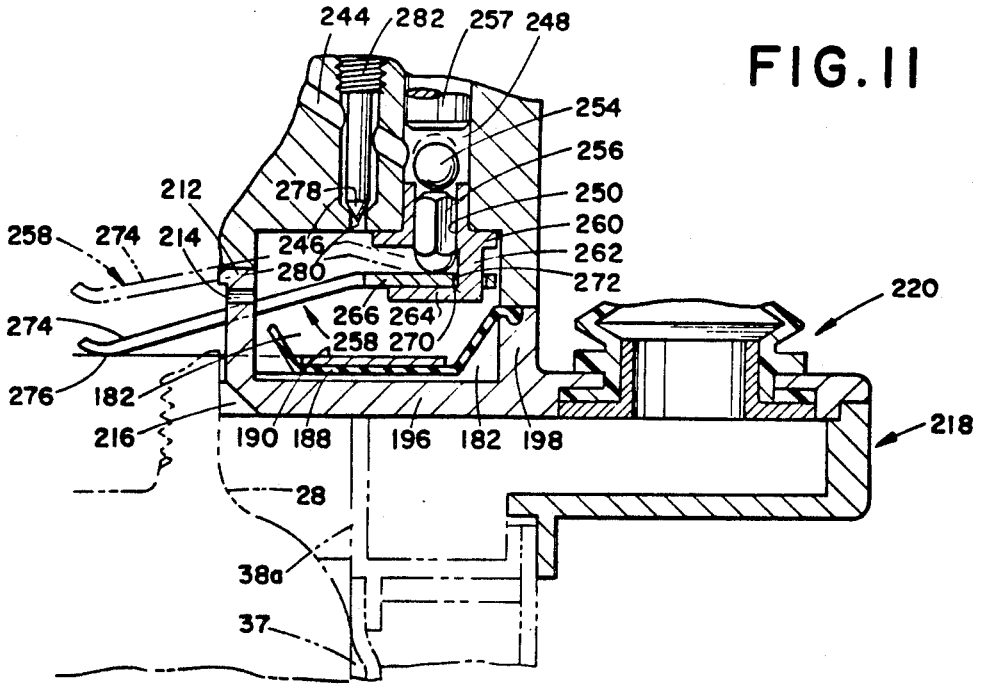
FIG. 11 is an enlarged detail view, in section, of the demand valve of the valve assembly shown in FIG. 9.
Figure 12:
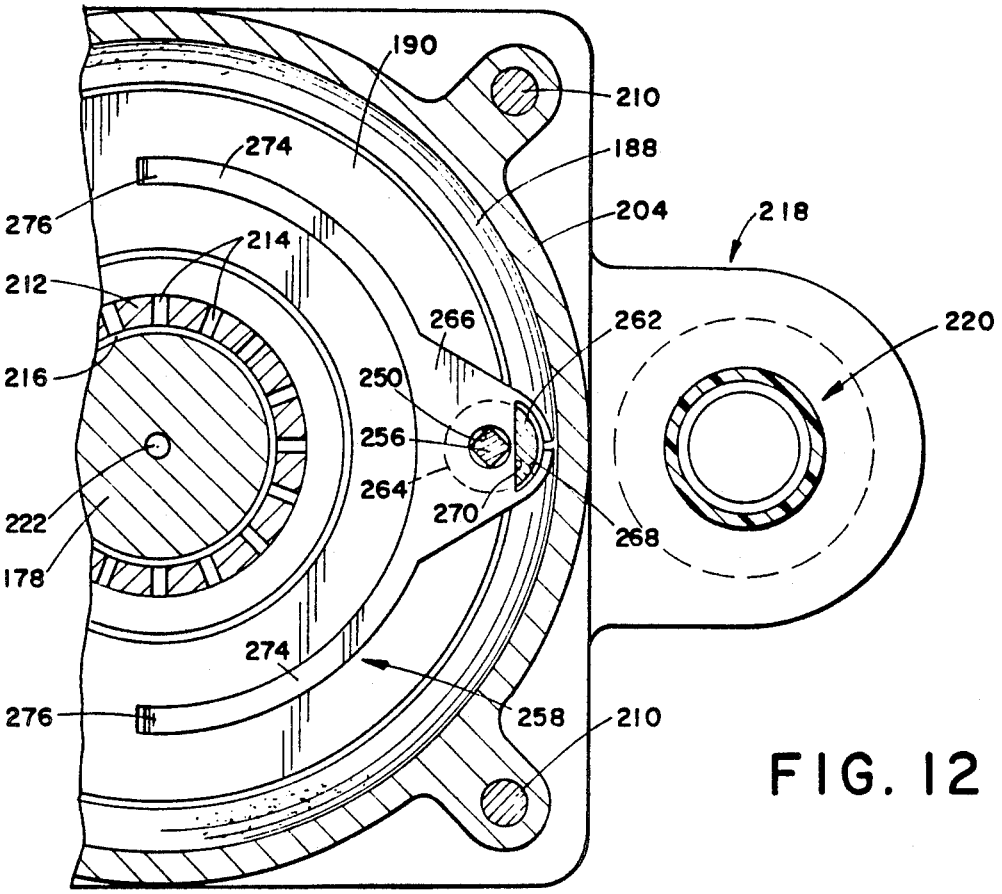
FIG. 12 is a cross-sectional view of the demand valve taken along line 12—12 in FIG. 9.
Figure 15:
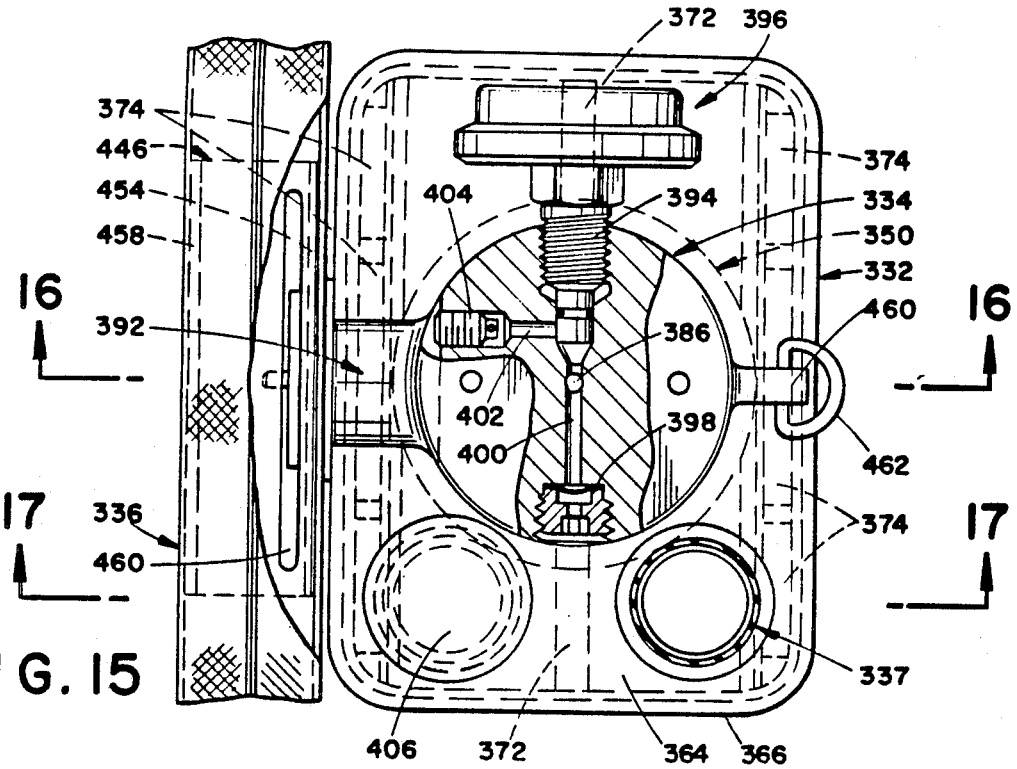
FIG. 15 is a plan view, partially in section, of another embodiment of breathing apparatus in accordance with the present invention.
Figure 19:
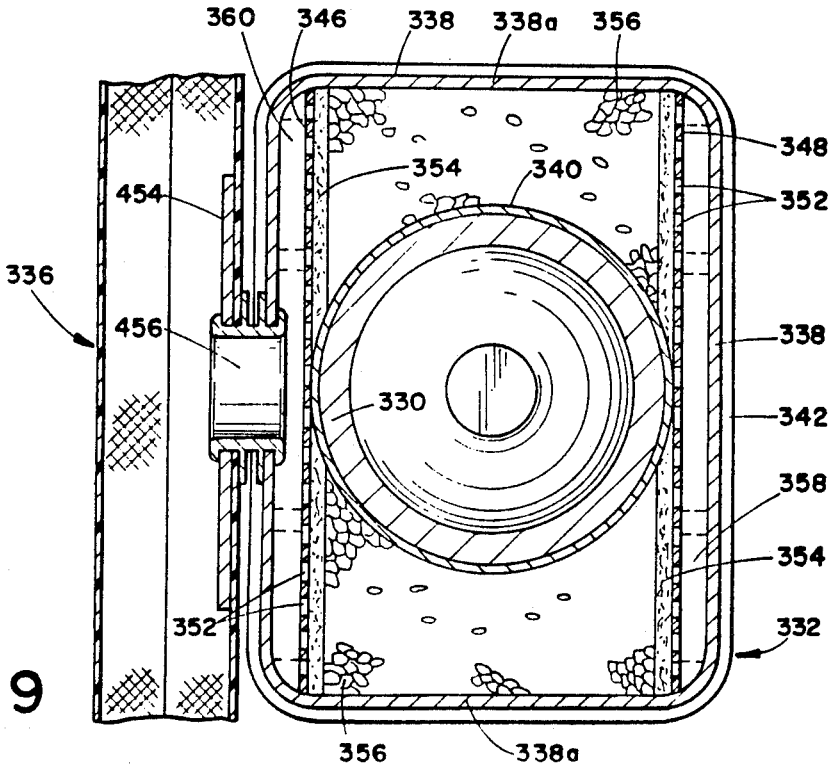

Passageway 250 is defined by an insert 260 in the lower end of ball valve chamber 248 and, as best seen in FIGS. 11 and 12, insert 260 includes a dowwnwardly extending arm 262 and a horizontally extending shelf 264. Actuator 258 is a generally semi-circular member having a mounting end 266 resting on shelf 264 and provided with an opening 268 therethrough which corresponds to the contour of arm 262 and through which the latter arm extends. Arm 262 and opening 268 have linear front edges defining a pivot axis 270 for the actuator member, and the front end of opening 268 is beveled as indicated by numeral 272 in FIG. 11 to enable pivoting of the actuator between the solid and broken line positions thereof shown in FIG. 11. Actuator 258 further includes a pair of arcuate legs 274 extending from mounting end 266 and having corresponding free ends 276 overlying and engaging diaphragm 188 at dianetrically opposite locations thereon. It will be appreciated that pivotal displacement of actuator 258 from the solid line to the broken line position thereof in FIG. 11 results in upward displacement of rod 256 and thus displacement of ball valve 254 upwardly in chamber 248 out of engagement with the upper end of passageway 250 thus to open the latter.

For the purpose set forth hereinafter, passageway 246 referred to hereinabove receives a needle valve component having a conical inner end 278 adapted to be adjustably positioned relative to a port 280 at the lower end of passageway 246 to provide for a predetermined restricted flow of oxygen into the diaphragm chamber. The needle valve includes an externally threaded outer end 282 engaged in an internally threaded bore therefor in body member 178, and a lock nut 284 is provided externally of body member 178 to lock the needle valve in an adjusted position. As best seen in FIGS. 9 and 10, valve assembly 176 further includes a horizontal passageway 286 having an internally threaded outer end to receive a pressure gauge 288 for visually indicating the pressure of oxygen in cylinder 10, and a fill port 290 is provided through body member 178 and has an inner end communicating with passageway 222 to facilitate filling cylinder 10 with oxygen under pressure. A spring biased ball valve 292 normally closes fill port 290 against the flow of oxygen outwardly therethrough. Finally, body member 178 is provided with a port 294 having its inner end in communication with passageway 222 and which is provided at its outer end with a burst disc arrangement 296 which, as is well known, is adapted to rupture in response to a predetermined excessive pressure in the system.

Figure 2:
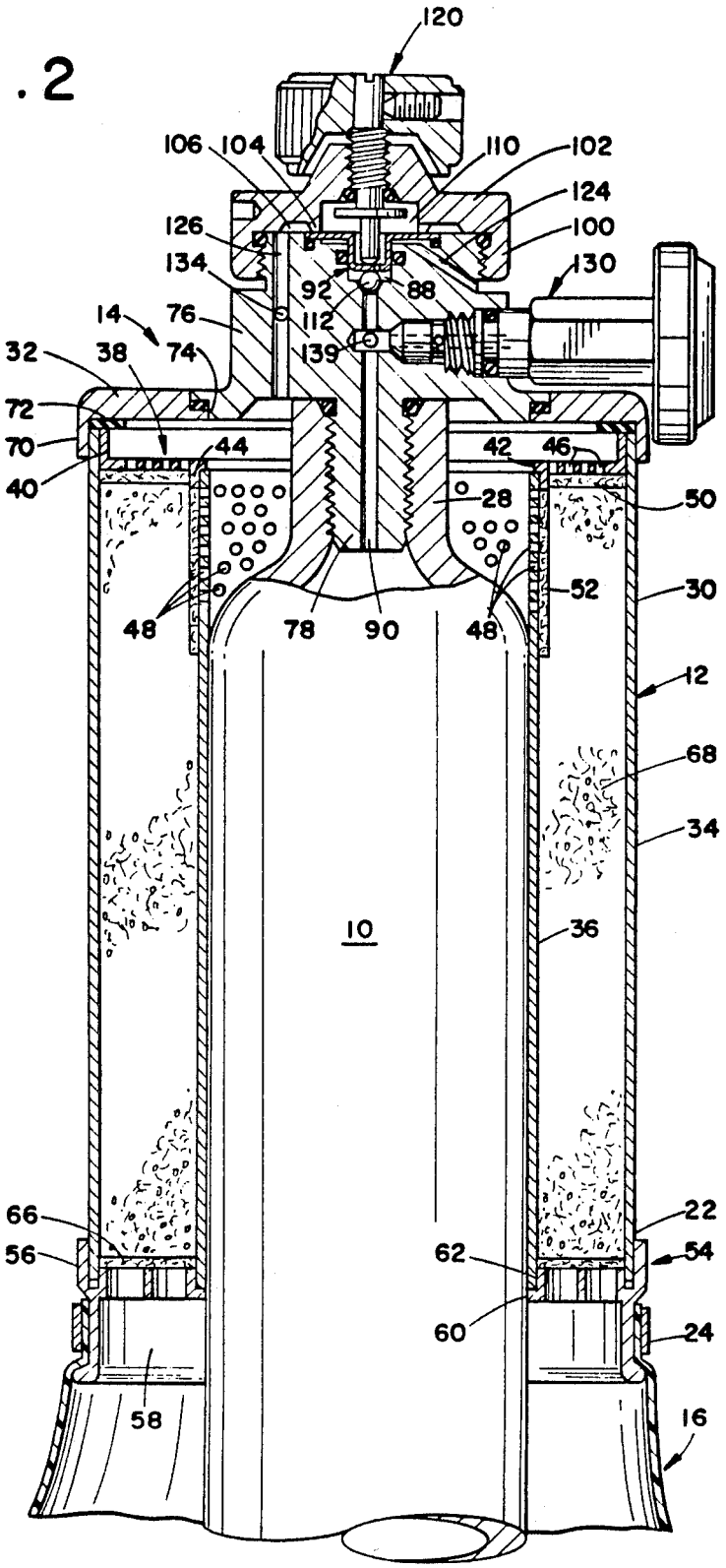
FIG. 2 is a sectional elevational view of the upper portion of the compressed air cylinder, scrubber canister and valve assembly of the apparatus.

In connection with closed circuit breathing apparatus including a demand valve, it is preferred to provide separated flow paths to the breathing bag for the oxygen supplied from cylinder 10 and the inhaled and exhaled breathing air of the user so as to prevent over reaction of the demand valve to inhalation of the user which results in excessive use of the oxygen supply during a given period of time. Accordingly, as will be seen from FIGS. 9 and 13 of the drawing, the apertured plate member 38 and inner wall 36 of the canister assembly shown in FIG. 2 are modified to provide a flow path for oxygen from cylinder 10 axially along the outer surface of the cylinder to the breathing bag and which flow path is separate from the flow path for inhaled and exhaled breathing gas which is axially through the canister between the radially inner and outer walls thereof. More particularly in this respect, apertured plate member 38 is modified to provide an axially upwardly extending annular wall 38a having an upper end which abuts against the underside of bottom wall 196 of end cap assembly 186, and the radially inner wall of canister 12 is corrugated as indicated by numeral 36a in FIGS. 9 and 13 to provide axially extending passageways 37 along the outer surface of cylinder 10. While not shown in FIGS. 9 and 13, it will be appreciated from FIG. 2 of the drawing that circular opening 60 and recess 62 in the lower end cap member 54 would be contoured to provide for the passageways 37 to open into the upper end of breathing bag 16. As will become apparent hereinafter in connection with the description of the operation of the apparatus, wall 38a precludes direct lateral flow of breathing gas in either direction between diaphragm chamber 182 and breathing hose 220.

It is believed that the following description of the operation of the apparatus illustrated in FIGS. 9–13 will be understood from the foregoing description of the apparatus. When the component parts of the apparatus are in the positions shown in the drawings, the system is at atmospheric pressure and the pressure of the oxygen in cylinder 10 displaces ball valve 224 upwardly to seat against sleeve 228 to close the system to flow of oxygen from the cylinder. When the apparatus is to be put into use, operating knob 242 is manipulated to displace Bellville washer 238, diaphragm 232 and thus ball valve 224 axially inwardly away from seating engagement with sleeve 228, whereby oxygen from cylinder 10 flows past the ball valve and through passageway 244 to second ball valve chamber 248. At the same time, oxygen flows through passageway 246 past end 278 of the needle valve and into diaphragm chamber 182 and thence through passageways 214 and 216 to passageways 37 and the breathing bag. When the user of the apparatus inhales, breathing gas is withdrawn from the breathing bag upwardly through scrubber 12 and into the inlet end of breathing tube 220. Thus, a vacuum is created in diaphragm chamber 182, whereby diaphragm 188 is elevated causing actuator member 258 to pivot clockwise in FIG. 11 about axis 270 to elevate second ball valve 254 from its seat. Oxygen from cylinder 10 then flows past ball valve 254 and into diaphragm chamber 182 and through ports 214 and passageway 216 to passageways 37 and the breathing bag. When the user of the apparatus exhales, the exhaled gas flows through the entrance end of breathing tube 220 and thence downwardly through scrubber 12 to breathing bag 16. The positive pressure of such exhaled gas is transmitted upwardly through passageways 37 to passageway 216 and ports 214 and diaphragm chamber 182. This causes diaphragm 188 to return to its lower position, whereby actuator member 258 pivots counterclockwise in FIG. 11 for second ball valve 254 to seat against and close passageway 250. In connection with such operation of the apparatus, inner end 278 of the flow restricting needle valve operates to allow a predetermined low flow of oxygen constantly into the system and, together with second ball valve 254 operates to create a back pressure in diaphragm chamber 226 tending to displace diaphragm 232 axially outwardly against the bias of Bellville washer 238. This operates to vary the position of ball valve 224 relative to its seat and thus the area therebetween for flow of oxygen from cylinder 10. Accordingly, it will be appreciated that diaphragm 232, Bellville washer 238 and ball valve 224 operate as a pressure reducing valve for controlling the pressure of oxygen flowing to the system from cylinder 10.

As the user of the apparatus continues to inhale and exhale, the re-breathed gas and oxygen from cylinder 10 circulate in the foregoing manner through the breathing circuit. The minimum amount of oxygen flowing from cylinder 10 is determined by the setting of inner end 278 of the flow restricting valve element, and the quantity of oxygen varies upwardly from the minimum in accordance with the need of the user which is reflected by the degree of the user's inhaling and resulting vacuum in recess 182 of the demand valve diaphragm chamber. As mentioned hereinabove, the accumulation of excess gas in breathing bag 16 operates to open relief valve 26 to vent such excess to atmosphere. When use of the apparatus has been completed, operating knob 242 is displaced to relieve the force of Bellville washer 238 against diaphragm 232 allowing the oxygen under pressure in cylinder 10 to displace ball valve 224 against its seat to close the flow of oxygen to the system from cylinder 10.

With reference now to FIG. 14 of the drawing, there is illustrated another embodiment of a pressure reducing valve designated generally by the reference numeral 298 and which corresponds in function to valve assembly 14 described hereinabove in connection with the embodiment illustrated in FIGS. 1–8. Valve 298 is structurally similar in many respects to valve assembly 14 and, accordingly, like reference numerals appear in FIG. 1–8 and 14 to designate similar features.

The primary difference between pressure reducing valve assembly 14 and valve assembly 298 shown in FIG. 14 resides in the diaphragm construction. In this respect, in the embodiment illustrated in FIG. 14, the diaphragm 300 is a thin, planar sheet metal disc having its outer periphery axially clamped between body member 76 and end cap 100. More particularly in this respect, the axially outer side of body member 76 is provided with a shallow recess 302 bounded by a peripherally continuous axially upwardly extending rib 304 underlying diaphragm disc 300, and the axially inner side of end wall 102 of end cap 100 is provided with an axially inwardly projecting annular rib 306 cooperable with rib 304 to clamp the diaphragm disc in place. The inner side of end wall 102 of end cap 100 further includes an annular rib 308 radially inwardly of rib 306 and providing a recess 310 therewith, and ribs 306 and 308 are provided with radially extending passageways 312 and 314, respectively, for the purpose set forth hereinafter. A circumferentially continuous recess 316 in the underside of end wall 102 extends about rib 306 and overlies a circumferentially continuous recess 318 in the outer end of body member 76 and which recess 318 is in communication with passageway 126 throug body portion 76. Passageway 90 through the valve body opens into recess 302 beneath the diaphragm disc, and an annular recess 320 surrounds the upper end of passageway 90 and receives a resilient O-ring 322 which engages against the underside of diaphragm disc 300. Diaphragm 300 is provided with a pair of ports 324 radially inwardly of rib 308 and O-ring 322, and a spherical ball 326 overlies diaphragm 300 between the latter and the axially inner end of valve actuating stem 114. An O-ring 328 is disposed axially behind ball element 326 to seal against the leakage of gas axially outwardly across the stem passageway.

It will be appreciated from FIG. 3 of the drawing that threaded nipple 78 of valve body portion 76 is received in the upper end of oxygen cylinder 10, and that passageway 126 is in communication with the upper end of scrubber 12. With the component parts in the positions shown in FIG. 14, the pressure reducing valve is open. In this respect, operating knob 120 has been displaced relative to end cap 100 to allow ball element 326 to move axially outwardly relative to diaphragm 300, whereby oxygen under pressure from cylinder 10 flows upwardly through passagewway 90 to displace diaphragm 300 upwardly against rib 308. Oxygen under pressure then flows through ports 324, radially outwardly across passageways 314 and 312 in ribs 308 and 306, into recesses 316 and 318, and thence through passageway 126 toward scrubber 12. The flow restricting needle valve associated with port 134 restricts the flow of oxygen through passageway 126 and thus creates a back pressure in recess 310 acting against the area of the upper side of diaphragm 300 within rib 306. Since the latter area is much greater than the area on the underside of the diaphragm exposed to oxygen under pressure from cylinder 10, namely the area within O-ring 322, the back pressure biases diaphragm 300 toward the open upper end of passageway 90, thus reducing the area for the flow of oxygen between the upper end of passageway 90 and the overlying portion of the diaphragm. When use of the apparatus is completed, operating knob 120 is actuated to displace ball element 326 axially inwardly against diaphragm 300 to positively displace the latter against the open upper end of passageway 90, whereby the latter is closed to the flow of oxygen from cylinder 10.

FIGS. 15–19 of the drawing illustrate yet another embodiment of closed circuit breathing apparatus in accordance with the present invention. With reference to the latter Figures, the apparatus is comprised of concentrically arranged component parts including an oxygen supply cylinder 330, a scrubber 332, and a flow control valve assembly 334. The apparatus further includes a breathing bag 336 and a breathing hose 337 leading to a hood or face mask, not shown.

Scrubber 332 is in the form of a canister having an outer wall 338 which is generally rectangular in cross-section and an inner wall 340 which is circular in cross-section and surrounds and engages the outer surface of cylinder 330. The lower end of scrubber 332 is closed by an annular end cap member 342 suitably secured to outer wall 338 of the scrubber and secured about the lower end of inner wall 340 and the outer surface of cylinder 330 by means of a clamping strap 344. The canister further includes a pair of partitions 346 and 348 which are parallel to one another and disposed on diametrically opposite sides of inner wall 340 of the scrubber and attached thereto such as by spot welding. Each of the partitions extends vertically between end cap member 342 at the bottom of the scrubber and a flow diverter 350 at the upper end of the scrubber, which diverter serves the purpose set forth hereinafter, and each of the partitions extends laterally between opposed wall portions 338*a* of outer wall 338 of the canister. Each of the partitions 346 and 348 is provided with openings 352 therethrough throughout the area between the opposite sides and ends thereof, and each of the partitions is backed by a sheet of felt or the like 354. The spaces between inner wall 340, outer wall portions 338*a* and the inner sides of felt sheets 354 provide a scrubbing chamber and are filled between the upper and lower ends of the canister with a granular carbon dioxide absorbing material 356 such as Soda-Sorb. For the purpose set forth hereinafter, the space along scrubber 332 between partition 348 and the adjacent portion of outer wall 338 of the scrubber provides a flow passageway 358 for breathing gas which directly communicates with breathing hose 339, and the space between partition 346 and the corresponding portion of outer wall 338 of the scrubber provides a flow passageway 360 directly communicating with breathing bag 336.

Valve assembly 334 includes a valve body 362 having an outwardly extending flange 364 at the lower end thereof which terminates in a downwardly extending peripheral skirt 366. The upper end of cylinder 330 terminates in a neck 368 which is externally threaded for threaded interengagement with an internally threaded bore in the bottom of valve body 362. Flow diverter 350 is in the form of an annular, dome-shaped collar engaging against the outer surface of cylinder 330 about neck 368 and includes a radially extending flange at the lower end thereof having a radially outer edge 370 conforming to the contour of outer wall 338 of the scrubber. Diverter 350 further includes a pair of diametrically opposed ribs 372 extending axially upwardly into engagement with the underside of valve body 362 and extending radially to engage the underside of flange 364 and the inner side of skirt 366 of the valve body. Skirt 366 is radially and axially recessed to receive the upper end of outer canister wall 338, and the radially outer end 370 of the flange of diverter 350 is axially captured between the upper end of wall 338 and the axially upper end of the recess in skirt 366. The radial flange of diverter 350 is provided with openings 374 radially inwardly of outer edge 370 thereof and overlying the upper end of the corresponding one of the flow passageways 358 and 360. The underside of the flange of diverter 350 radially inwardly of openings 374 is axially and radially recessed to receive the upper ends of canister wall 340 and partitions 346 and 348. When neck 368 of cylinder 330 is screwed into the bore therefor in valve body 362, the canister assembly is axially clamped in place against skirt 366 and diverter 350 by clamping strap 344 to hold the component parts in assembled relationship.

Valve assembly 334 includes a shutoff and pressure reducing valve unit 376 which is structurally and functionally similar to valve assembly 298 described hereinabove in connection with FIG. 14. Briefly in this respect, valve 376 includes a flat sheet metal diaphragm 378 mounted in a recess in the upper end of valve body 362 by means of an externally threaded plug 380 and which plug supports a rotatable operating knob 382 for controlling the position of a ball 384 relative to the diaphragm and the latter relative to an axial flow port 386 in valve body 362. Flow port 386 opens between the underside of diaphragm 378 and the open upper end of cylinder 330 and, as will be appreciated from the description of the valve illustrated in FIG. 14, diaphragm 378 is provided with a pair of openings therethrough radially outwardly of ball 384 and radially inwardly of an O-ring seal surrounding port 386. In the embodiment shown in FIG. 16, the underside of diaphragm 378 is vented to the breathing bag side of canister 332 by means of a port 388, the threaded neck of cylinder 330 and a radial slot 389 in diverter 350. Port 390 in valve body 362 corresponds to port 126 in the embodiment of the valve illustrated in FIG. 14 and thus serves to provide a flow path for oxygen from cylinder 330 to breathing bag 336 through a demand and flow restricting valve unit 392 to be described in detail hereinafter.

Figure 17:
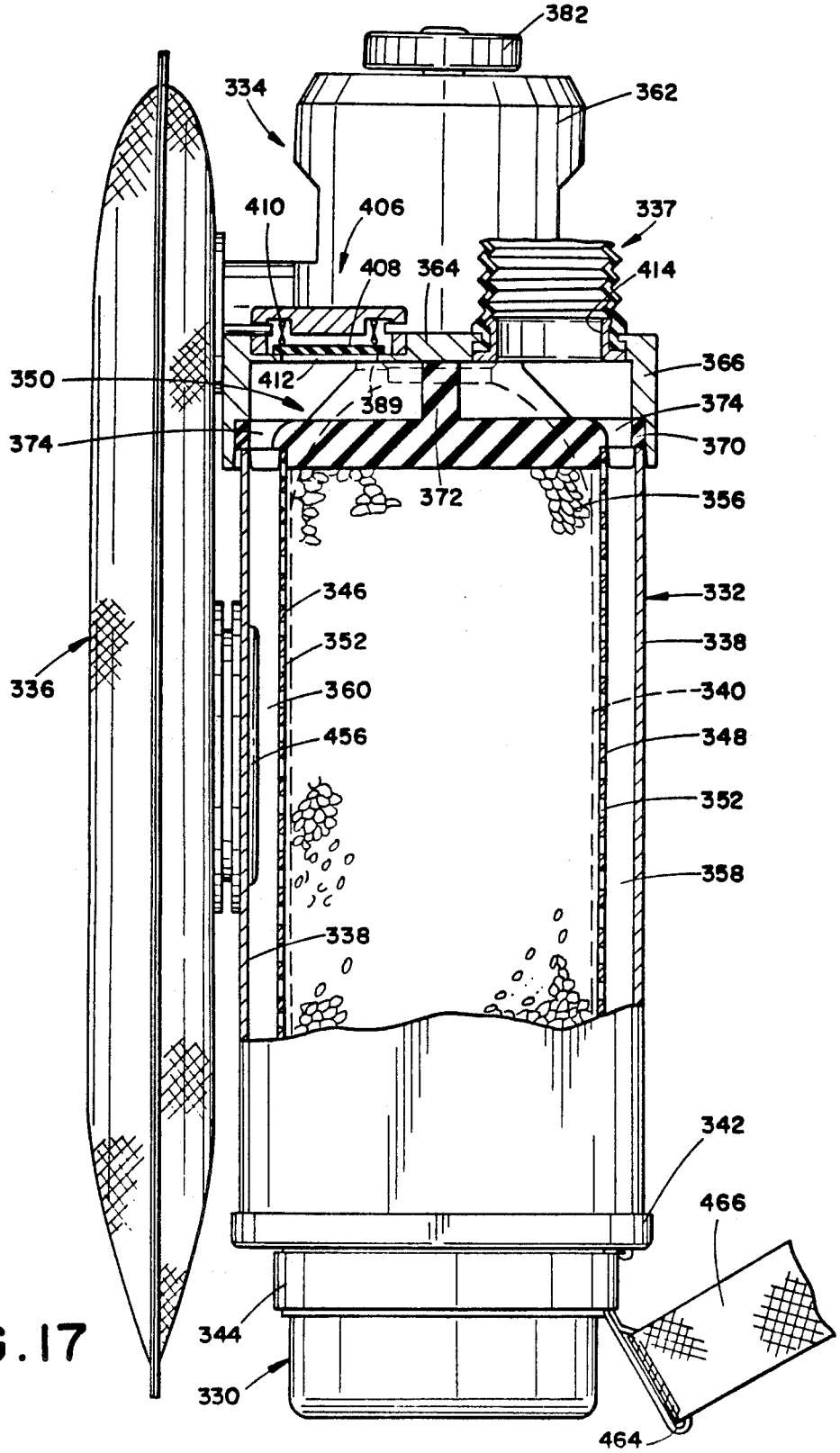
FIG. 17 is a sectional elevation view taken along line 17—17 in FIG. 15.

Valve assembly 334 further includes a laterally extending passageway 394 in valve body 362 having an inner end communicating with port 386 and which is adapted to receive a pressure gauge 396. A high pressure relief or burst valve 398 is provided in valve body 362 and is in communication with port 386 by means of a passageway 400, and a fill port 402 is provided in the valve body and has an inner end communicating with passageway 394 for pressure gauge 396. A spring biased check valve 404 provides for the inflow of oxygen to cylinder 330 while preventing air escape through the fill port. Flange 364 of valve body 362 supports a low pressure relief valve 406 which, as best seen in FIG. 17, is in communication with breathing gas passageway 360 through the corresponding openings 374 in diverter 350. Valve 406 comprises a valve disc 408 biased by a spring 410 to close an opening 412 which communicates the interior of the breathing circuit with atmosphere. It will be appreciated that disc 408 is displaced upwardly against the bias of spring 410 in response to a predetermined low pressure in the breathing circuit whereby the excess breathing gas is vented to atmosphere. As will also be appreciated from FIG. 17, breathing hose 337 is connected to the periphery of an opening through flange 364 of valve body 362 by means of a coupling sleeve 414 whereby the hose opens into breathing gas passageway 358 through the corresponding openings 374 in diverter 350. It will be appreciated from the foregoing description that ribs 372 of the diverter prevent the flow of breathing gas directly across the top of the scrubber.

Figure 16:
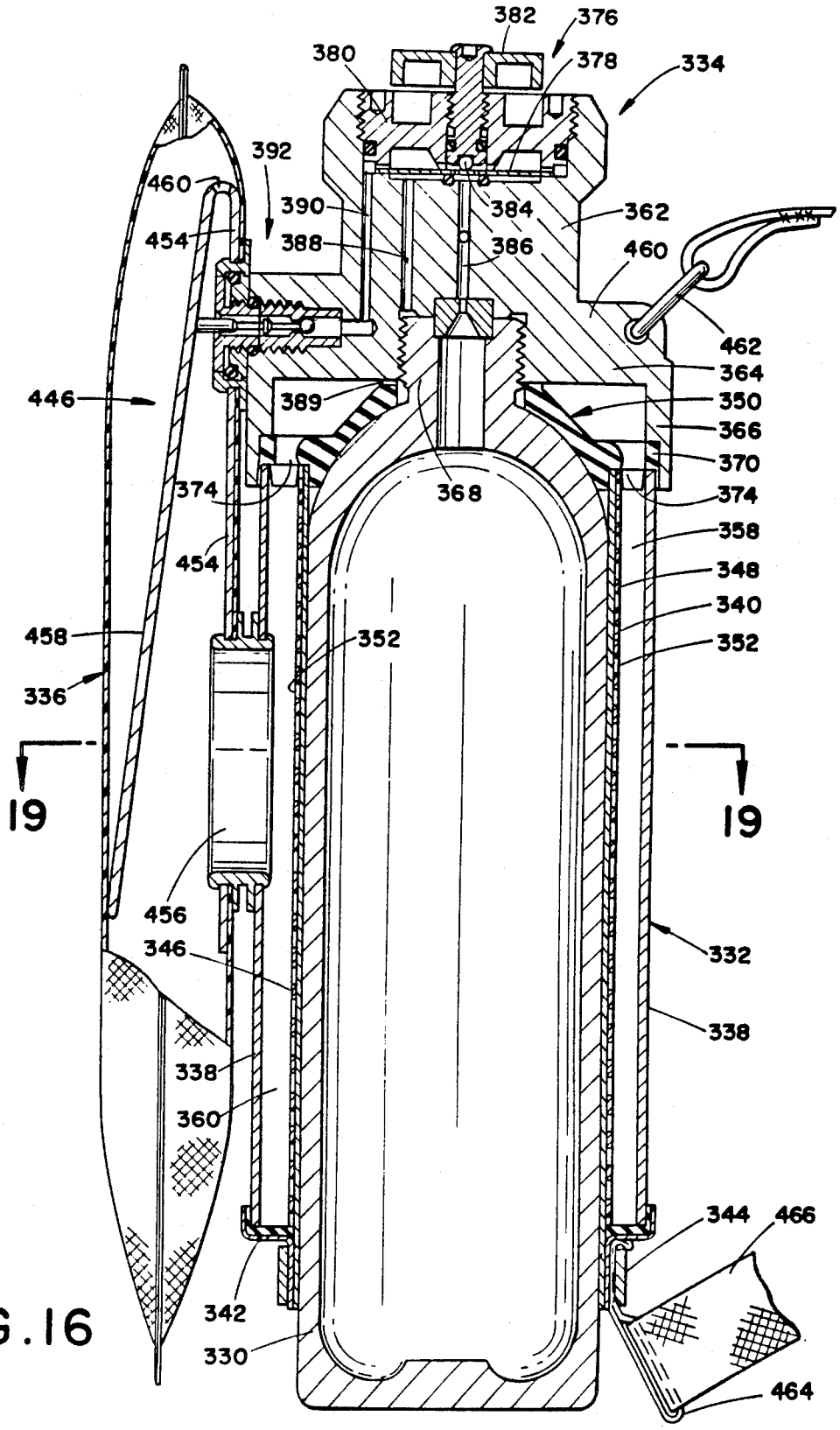
FIG. 16 is a sectional elevation view taken along line 16—16 in FIG. 15.
Figure 18:
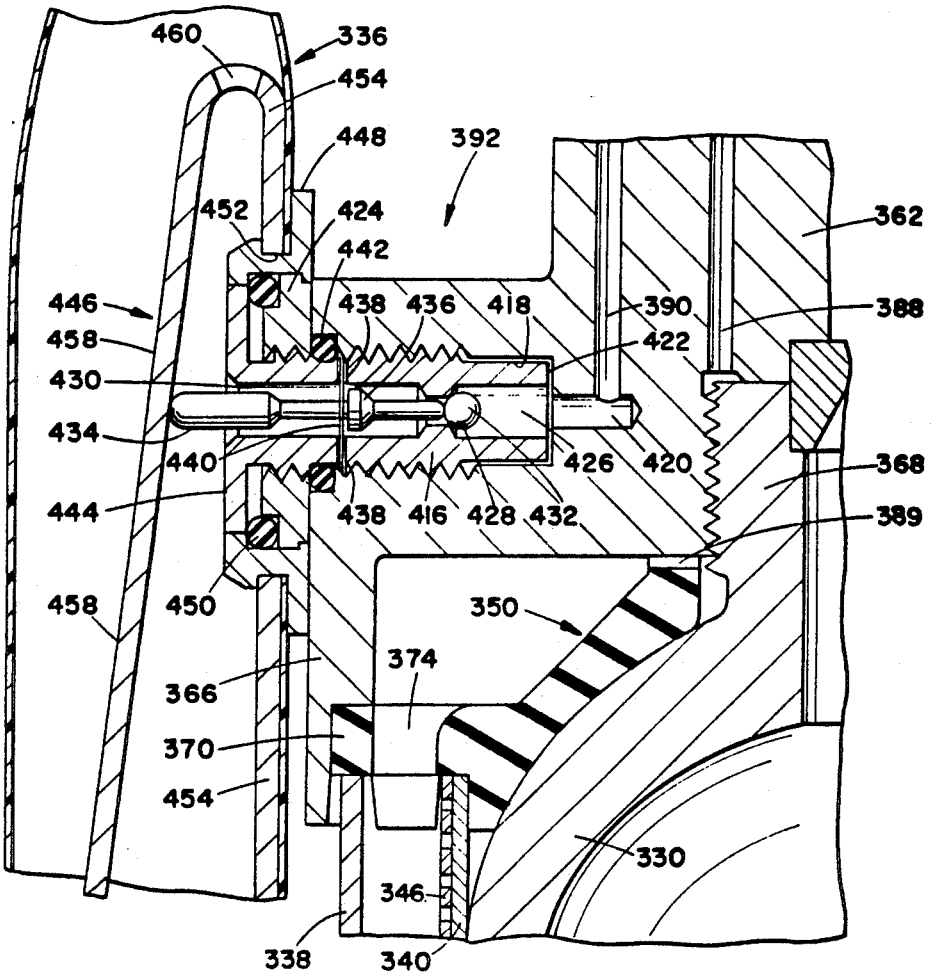
FIG. 18 is an enlarged detail view, in section, of the demand and flow restricting valve of the valve assembly shown in FIG. 16; and, FIG. 19 is a cross-sectional view of the apparatus taken along line 19—19 in FIG. 16.

As mentioned hereinabove, valve assembly 334 includes a demand and flow restricting valve unit 392 which communicates the interior of breathing bag 336 with oxygen from cylinder 330. As best seen in FIGS. 16 and 18 of the drawing, valve unit 392 includes a nipple 416 exteriorly threaded along an intermediate portion thereof for threaded interengagement with the outer end of a bore 418 in valve housing 362. A port 420 connects the inner end of bore 418 with port 390 in the valve body. The inner end of nipple 416 is slightly less in diameter than the diameter of bore 418, and the nipple terminates in an end face 422 which, through the threaded interconnection of the nipple with bore 418, is adapted to be adjusted axially toward and away from the inner end face of bore 418 for the purpose set forth hereinafter. When nipple 416 is in the desired position relative to bore 418, a lock nut 424 serves to retain the nipple in the adjusted position. Nipple 416 includes an axially extending passageway therethrough having an inner end 426 provided with a conical valve seat 428 and a smaller diameter outer end 430. A ball valve element 432 is disposed in inner end 426 of the passageway and is attached to a valve stem having an enlarged outer end 434 which extends into breathing bag 336 for the purpose set forth hereinafter. The portion of the valve stem between end 434 and ball valve 432 is of smaller diameter and is provided with a guide collar 436 to limit lateral play relative to the passageway when ball valve element 432 is displaced from seat 428. Further, nipple 416 is provided with an opening 438 transversely therethrough which receives a piece of wire 440 of smaller diameter than the opening and which wire is adapted to engage against the axially inner end of end 434 of the valve stem to limit axial displacement of the ball valve away from seat 428. An O-ring 442 engages about nipple 416 and the outer end of the threaded portion of bore 418 to seal against the leakage of oxygen across the juncture therebetween.

Nipple 416 provides an adjustable restriction for controlling the flow of oxygen from cylinder 330 to breathing bag 336 so as to provide a constant minimum flow of oxygen to the breathing bag and to provide a back pressure relative to perform its pressure reducing function in the manner described hereinabove in connection with the embodiment of FIG. 14. More particularly with regard to the restricted flow path, the desired restriction of oxygen flow is achieved by axially adjusting the position of nipple 416 so as to increase or decrease the space between end face 422 thereof and the opposed inner face of bore 418. Oxygen flowing from cylinder 330 enters inner end 426 of the passageway in nipple 416 and, when ball valve 432 is closed against seat 428, the oxygen flows radially outwardly across the space between the end faces of the nipple and bore 418 and thence axially along the outer surface of nipple 416. The oxygen then flows across the threads between the nipple and bore 418 and thence radially inwardly through opening 438 into passageway 430 and axially past stem portion 434 into the breathing bag. The fit between the threads on nipple 416 and bore 418 may provide for sufficient flow of oxygen thereacross or, alternatively, an axially extending groove can be provided across the threads of nipple 416 for this purpose.

The axially outer end of nipple 416 terminates in a radial flange 444 corresponding generally in diameter and contour with lock nut 424, and breathing bag 336 and a demand valve actuator 446 are mounted on flange 444 and nut 424 by means of a mounting collar 448 which is slidably received over the flange and nut and has a snap-fit with the latter to retain the collar in place. An O-ring seal 450 is interposed between the inner periphery of collar 448 and adjacent portions of flange 444 and nut 424 to seal against the leakage of breathing gas thereacross. The outer periphery of mounting collar 448 is provided with a peripherally continuous circular recess 452 by which breathing bag 336 and demand valve actuator 446 are clampingly retained on the collar. More particularly in this respect, demand valve actuator 446 is an inverted V-shaped component of sheet metal or suitable plastic having a mounting leg 454 apertured adjacent the closed end of the V to have a snap-fit interengagement with recess 452, and the corresponding wall of breathing bag 336 is apertured to be received in recess 452 behind leg 454 and to be clampingly and sealingly interengaged with the recess by leg 454. Breathing bag 336 is further open to breathing gas flow passageway 360 for the flow of breathing gas into and out of the breathing bag. In the embodiment shown, and as best seen in FIG. 16, such communication is achieved by means of a circular collar 456 having a snap-fit interengagement with canister wall 338 and a snap-fit interengagement with the lower end of mounting leg 454 of demand valve actuator 446 with the periphery of a corresponding aperture in the breathing bag clampingly interengaged behind leg 454. In addition to providing communication between the interior of breathing bag 336 and passageway 360, it will be appreciated that collar 456 serves to rigidly retain leg 454 in place relative to the scrubber canister.

Demand valve actuator 446 further includes an actuating leg 458 which is displaceable toward and away from leg 454 in the manner and for the purpose set forth hereinafter, and the closed end of the V is provided with an elongate slot 460 which optimizes the flexibility of leg 458. Outer end 434 of the valve stem of ball valve 432 engages against the inner side of leg 458 adjacent the closed end of the V, and it will be appreciated that displacement of leg 458 to the right in FIGS. 16 and 18 operates to displace ball valve 432 from engagement with seat 438 to open passageway 430 to the flow of oxygen from cylinder 330. The normal position of leg 458 is that shown in FIGS. 16 and 18 in which ball valve element 432 engages against seat 428 to close passageway 430, whereby it will be appreciated that displacement of leg 458 to the right in the latter Figures is against the inherent bias of the material of the actuator to return leg 458 to the normal position. Further with regard to FIG. 16, breathing bag 336 is illustrated in an inflated or at least partially inflated disposition allowing leg 458 to move to its normal position and, upon collapse of the breathing bag by the withdrawal of breathing gas therefrom, the outer wall of the bag displaces leg 458 to the right so as to displace ball valve 432 away from seat 428 to open passageway 430. When the breathing bag is inflated and leg 458 is in the normal position, ball valve 432 is held against seat 428 by the pressure of oxygen therebehind. In order to facilitate support of the breathing apparatus on a person's body during use, valve body 362 is provided with an integral mounting lug 460 which is apertured to receive a D-ring 462 by which a suitable neck strap is attached to the apparatus for support thereof about the neck of the user. Further, a body strap support loop 464 is attached to the bottom of the apparatus by positioning a portion thereof beneath clamping strap 344, and loop 464 receives a body strap 466 adapted to extend about the body of a user and having free ends which are adapted to be suitably interengaged to hold the apparatus against the user's body.

In operation of the apparatus, it will be appreciated that when the shutoff and pressure regulating valve unit 376 is in its closed position ball 384 depresses diaphragm 378 downwardly to close the upper end of port 386 and thus close cylinder 330 against the flow of oxygen therefrom. Also at this time, breathing bag 336 is collapsed whereby leg 458 of the demand valve actuator is displaced to the right from the position shown in FIGS. 16 and 18 and passageway 430 in the demand valve is open. When the user rotates operating knob 382 to open the shutoff and pressure regulating valve, oxygen from cylinder 330 flows through port 386 across the apertures in diaphragm 378, laterally across the upper surface of the diaphragm to port 390 and thence into demand valve passageways 426 and 430 to the interior of breathing bag 336. Such flow of oxygen from cylinder 330 to the breathing bag will continue until such time as the breathing bag expands to the extent necessary for leg 458 of the demand valve actuator to move to the position shown in FIGS. 16 and 18 so that ball valve 432 is displaced against seat 428 by the pressure of oxygen therebehind. Expansion of the breathing bag in this respect can of course be the result of a combination of flow of oxygen from cylinder 330 and exhalation of breath by the user once the latter has the hood or face mask in place. Assuming the breathing bag to be expanded as shown in FIG. 16, inhalation by the user draws breathing gas from the breathing bag into passageway 360 along the entire length thereof, across the scrubbing chamber between apertured partitions 346 and 348 to passageway 358, and thence upwardly through breathing hose 339 to the face mask or hood being worn by the user. Such withdrawal of breathing gas from breathing bag 336 causes the latter to collapse, whereby leg 458 of the demand valve actuator is displaced as described hereinabove to open passageway 430 for the flow of oxygen from cylinder 330 into the breathing bag. When the user exhales, the exhaled breathing gas flows downwardly into passageway 358, across the scrubbing chamber to passageway 360, and thence through collar 456 into the breathing bag. Such flow of breathing gas into the breathing bag expands the latter, whereby leg 458 is biased to the position shown in FIGS. 16 and 18 to allow ball valve 432 to close against seat 428 under the pressure of oxygen from cylinder 330 and to close passageway 430 to the flow of oxygen to the breathing bag. Sequential inhaling and exhaling by the user results in repeated flow of breathing gas and oxygen from cylinder 330 in the foregoing manner. When the pressure in the breathing circuit exceeds a predetermined low level as a result of the introduction of oxygen into the system from cylinder 330, valve disc 408 of the low pressure relief valve is displaced upwardly to vent excess pressure to atmosphere.

While demand valve actuator 446 operates to intermittently supply oxygen from cylinder 330 to the breathing circuit in response to demands of the user which are reflected by the latter's inhaling and exhaling, the demand and flow restricting valve unit 392 provides for a predetermined low flow of oxygen constantly into the breathing bag and operates to create a back pressure against the upper side of diaphragm 378 of the pressure regulating valve. Such back pressure is operable as described in connection with other embodiments herein to reduce and maintain a desired level of pressure for oxygen flowing from cylinder 330. Such constant flow is along the flow path described hereinabove as being provided between the inner faces of nipple 416 and bore 418, the circumferential space between the nipple and bore, and passageway 438 through the nipple, and the restricted flow along this path is variable by adjusting the spacing between end face 422 of the nipple and the inner end face of bore 418. When use of the apparatus is completed, operating knob 382 is displaced for ball 384 to depress diaphragm 378 downwardly to close the upper end of port 386 and thus to shutoff the flow of oxygen from cylinder 330. Removal of the face mask or hood opens the breathing hose to atmosphere, whereby any breathing gas in breathing bag 336 can be displaced therefrom to collapse the breathing bag, whereby leg 458 of the demand valve actuator is displaced to the right in FIGS. 16 and 18 to open flow passageway 430 of the demand valve in readiness for the next use of the apparatus.

During the operation of each of the embodiments described hereinabove, it will be appreciated that the breathing gas flow circuit provides for re-breathed gas to flow back and forth through the scrubber and across the outer surface of cylinder 10, thus promoting desirable heat transfer between the scrubber and oxygen cylinder completely about the cylinder and along the length thereof corresponding to the length of the scrubber.

While considerable emphasis has been placed herein on the preferred embodiments and the structures and structural interrelationships between the component parts thereof, it will be appreciated that other embodiments of the invention can be made and that modifications can be made in the embodiments herein illustrated and described without departing from the principles of the invention. In this respect, for example, it will be appreciated that other cross-sectional configurations can be provided for the scrubber component, it only being important in connection with the present invention that the scrubber and compressed air container have portions which are coaxial with respect to the container axis and that the scrubber portions are radially outwardly adjacent the compressed air container. Further, it will be appreciated that compressed air cylinders of different lengths can be used with a scrubber having a given length, thus to vary the duration of use capability of the apparatus. Still further it will be appreciated that other valve assembly structures and other mounting arrangements for the valve assembly on the upper end of the oxygen cylinder and scrubber can be devised which will provide the desired coaxial relationship of the valve assembly and the operating component parts thereof with respect to the apparatus. These and other modifications of the preferred embodiments as well as other embodiments of the invention will be obvious or suggested to those skilled in the art upon reading and understanding the description of the preferred embodiments herein. Accordingly, it is to be distinctly understood that the foregoing descriptive matter is to be interpreted merely as illustrative of the present invention and not as a limitation.

Having thus described the invention, it is claimed:

1. A fluid flow control valve for use with portable emergency breathing apparatus including breathing gas container having an open end, comprising a valve body mountable on said compressed breathing gas container, said valve body having an axis and fluid flow passageway means therethrough, said passageway means including inlet and outlet passages, said inlet passage being coaxial with said axis in flow communication with breathing gas under pressure in said container when said valve body is mounted thereon, pressure reducing valve means between said inlet and outlet passages and including a first diaphragm coaxial with said axis, pressure responsive valve means downstream from said pressure reducing valve means and including a second diaphragm coaxial with said axis, said passageway means further includes a first portion between said pressure reducing valve means and one side of said second diaphragm and a second portion between said one side of said second diaphragm and said outlet passage, said second diaphragm being displaceable in axially opposite directions between first and second positions corresponding respectively to a first pressure on said one side thereof and a second pressure on said one side less than said first pressure, and said pressure responsive valve means further including displaceable valve element means closing said first passageway portion when said second diaphragm is in said first position, said valve element means being responsive to displacement of said second diaphragm from said first position toward said second position to pen said first passageway portion for flow of fluid therethrough from said pressure reducing valve means to said one side of said second diaphragm.

2. A valve according to claim 1, wherein said pressure reducing valve means includes a first diaphragm chamber in said body for said first diaphragm, said inlet passage having opposite ends, one of said opposite ends opening into said first diaphragm chamber.

3. A valve according to claim 2, wherein said second diaphragm is annular and said pressure responsive valve means includes an annular second diaphragm chamber for said second diaphragm.

4. A valve according to claim 3, wherein said second diaphragm chamber surrounds said inlet passage between said opposite ends thereof.

5. A valve according to claim 4, wherein said second diaphragm chamber has radially inner and outer peripheral edges, said first passageway portion having an outlet end opening into said second chamber adjacent said radially outer edge, seat means in said outlet end of said first passageway portion, and said displaceable valve element means being displaceable into and out of engagement with said seat means to close and open said first passageway portion.

6. A valve according to claim 5, wherein said second passageway portion opens into said second diaphragm chamber adjacent said radially inner edge.

7. A valve according to claim 6, wherein said outlet passage is annular and coaxial with said axis, said second diaphragm chamber having an axially extending annular wall providing said radially inner edge, said second passageway portion including a plurality of openings spaced apart about and extending radially through said annular wall.

8. A valve according to claim 5, wherein said second diaphragm chamber has a wall between said radially inner and outer edges and facing said one side of said second diaphragm, and said outlet end of said first passageway portion opens through said wall.

9. A valve according to claim 8, wherein said pressure responsive valve means further includes actuator means for said valve element means, said actuator means being interposed between said second diaphragm and said valve element means to displace said valve element means in opposite directions in response to displacement of said second diaphragm in opposite directions.

10. A valve according to claim 9, wherein said actuator means includes lever means pivotally supported in said second diaphragm chamber adjacent said radially outer edge and having leg means engaging said one side of said second diaphragm.

11. A valve according to claim 10, wherein said lever means is a generally U-shaped member having a closed end and a pair of legs extending therefrom, said closed end being supported in said second chamber for pivotal displacement of said member about a pivot axis parallel to said second diaphragm, said legs engaging said one side of said second diaphragm at generally diametrically opposite locations thereon, and said actuator means further includes pin means between said valve element means and said closed end of said U-shaped member and engaging said closed end at a location spaced from said pivot axis.

12. A valve according to claim 11, wherein said second passageway portion opens into said second diaphragm chamber adjacent said radially inner edge.

13. A valve according to claim 12, whwerein said outlet passage is annular and coaxial with said axis, said second diaphragm chamber having an axially extending annular wall providing said radially inner edge, said second passageway portion including a plurality of openings spaced apart about and extending radially through said annular wall.

* * * * *